US009824619B2

(12) United States Patent
Hudson et al.

(10) Patent No.: US 9,824,619 B2
(45) **Date of Patent: *Nov. 21, 2017**

(54) MODULATION SCHEME FOR DRIVING DIGITAL DISPLAY SYSTEMS

(71) Applicant: Jasper Display Corp., Hsinchu (TW)

(72) Inventors: Edwin Lyle Hudson, San Jose, CA (US); David Charles McDonald, Naples, FL (US)

(73) Assignee: JASPER DISPLAY CORP., Hsinchu (TW)

( * ) Notice: Subject to any disclaimer, the term of this patent is extended or adjusted under 35 U.S.C. 154(b) by 0 days.

This patent is subject to a terminal disclaimer.

(21) Appl. No.: 15/408,869

(22) Filed: Jan. 18, 2017

(65) Prior Publication Data

US 2017/0124935 A1 May 4, 2017

Related U.S. Application Data

(63) Continuation of application No. 13/790,120, filed on Mar. 8, 2013, now Pat. No. 9,583,031, which is a continuation of application No. 10/435,427, filed on May 9, 2003, now Pat. No. 8,421,828.

(60) Provisional application No. 60/427,814, filed on Nov. 20, 2002, provisional application No. 60/379,567, filed on May 10, 2002.

(51) Int. Cl.
*G09G 3/20* (2006.01)
*G09G 3/36* (2006.01)

(52) U.S. Cl.
CPC ..... *G09G 3/2037* (2013.01); *G09G 3/36* (2013.01); *G09G 2310/0216* (2013.01); *G09G 2310/0218* (2013.01)

(58) Field of Classification Search
None
See application file for complete search history.

(56) References Cited

U.S. PATENT DOCUMENTS

| | | | |
|---|---|---|---|
| 5,189,406 | A | 2/1993 | Humphries et al. |
| 5,767,832 | A | 6/1998 | Koyama et al. |
| 6,034,659 | A | 3/2000 | Wald et al. |
| 6,121,948 | A | 9/2000 | Worley, III et al. |
| 6,297,788 | B1 | 10/2001 | Shigeta et al. |
| 6,369,782 | B2 | 4/2002 | Shigeta |

(Continued)

OTHER PUBLICATIONS

Timothy J. Drabik, "Optically Interconnected Parallel Processor Arrays", Dec. 1989, p. 121-126, Georgia Institute of Technology, GA, USA.

(Continued)

*Primary Examiner* — Antonio Xavier
(74) *Attorney, Agent, or Firm* — WPAT, PC

(57) ABSTRACT

A display device and modulation scheme for applying image data to an imager is disclosed. The display may use a modulation scheme wherein spacing of row write actions on the rows creates gray scale modulation, wherein one row spacing between sequential row write actions is at a first distance while another row spacing between sequential row write actions is at a distance greater than said first distance. The modulation scheme may create a series of write pointers that create a corresponding series of write planes. In some embodiments, modulation efficiency is increased allowing the use of lower frequency imaging circuits to achieve the same display image.

6 Claims, 28 Drawing Sheets

(56) References Cited

U.S. PATENT DOCUMENTS

| | | | | |
|---|---|---|---|---|
| 6,784,898 | B2 | 8/2004 | Lee et al. | |
| 8,421,828 | B2 * | 4/2013 | Hudson | G09G 3/3648 345/690 |
| 2004/0080482 | A1 * | 4/2004 | Magendanz | G06F 3/1431 345/100 |
| 2007/0252855 | A1 | 11/2007 | Hudson | |
| 2007/0252856 | A1 | 11/2007 | Hudson et al. | |
| 2010/0073270 | A1 | 3/2010 | Ishii et al. | |
| 2016/0365055 | A9 * | 12/2016 | Hudson | G09G 3/002 |

OTHER PUBLICATIONS

Dewitt G. Ong, "Modem Mos Technology: Processes, Devices, and Design",1984, p. 207-209, McGraw-Hill Book Company, Arizona, USA.

Intel, "Intel Component Data Catalog", Jan. 1982, Intel Corporation, Santa Clara, CA, USA.

* cited by examiner

Top of Image — Single write pointer

| Bit Value | | Row Separation (Binary Weighted) | Row Separation (lsb stretched) |
|---|---|---|---|
| $2^0$ | 1 | 4 | 5 |
| $2^1$ | 2 | 8 | 8 |
| $2^2$ | 4 | 16 | 16 |
| $2^3$ | 8 | 32 | 32 |
| etc | | etc | etc |

In the above table, the time modulation value of the lsb is stretched by 25% by virtue of the increase of the row spacing from 4 to 5.

Fig. 13b

MODULATION SCHEME FOR DRIVING DIGITAL DISPLAY SYSTEMS

CROSS-REFERENCE TO RELATED APPLICATIONS

This application is a Continuation of U.S. patent application Ser. No. 13/790,120, "MODULATION SCHEME FOR DRIVING DIGITAL DISPLAY SYSTEMS," which is a continuation of U.S. patent application Ser. No. 10/435,427, now U.S. Pat. No. 8,421,828, filed May 9, 2003.

FIELD OF THE INVENTION

The present invention pertains to modulation schemes for driving digital displays, and more particularly to modulating an array of pixels of a micro-display or spatial light modulator.

BACKGROUND OF THE INVENTION

Liquid crystal display (LCD) technology has progressed rapidly in recent years, and has become an increasingly common option for display systems, currently making up the largest portion of the flat panel display market. This market dominance is expected to continue into the future. The superior characteristics of liquid crystal displays with regard to weight, power, and geometry in image visualization, have enabled them to compete in fields historically dominated by Cathode Ray Tube (CRT) technology, such as high definition television systems, desktop computers, projection equipment, and large information boards. As the cost of LCD systems continues to fall, it is predicted that they will eventually take over the market for traditional CRT applications.

The biggest disadvantages of current CRT systems are their geometrically bulky size and weight, as well as their high power consumption. These disadvantages are clearly evident when comparing the features of CRT and LCD projection displays with similar characteristics. In general, projection display systems offer several additional advantages over CRT systems. First, projection display systems offer the possibility of using large screens for group viewing with the ability to easily change the image size and position. Second, projection display systems offer high performance, and the ability to accept image data input from a variety of devices such as computers, television broadcasts, and satellite systems. Virtually any type of video input can be projected through such a system. The application of LCD's to projection systems has further attractive features such as high brightness, high resolution, and easy maintenance. LCD front projection displays provide higher resolution and brightness than comparable CRT-based systems. In comparison with CRTs, installation of LCD projection systems is easy and their viewing angles are generally much wider. Most front projection LCD display systems are compatible with personal computers and can operate with video signals from television systems. LCD front projectors are easily adapted for applications such as home theaters.

Typically, LCD projection systems include one or more small LCD panels, usually ranging from 1 to 5 inches in diagonal, a series of dichroic mirrors or filters, and a series of projection lenses. Commonly, three LCD panel systems are used, where one or more dichroic mirrors divide white light coming from a light source, into the three primary colors of red, green, and blue (RGB). The dichroic mirrors direct each of the RGB components toward a separate LCD panel. The corresponding LCD panel modulates each of the RGB components of the light according to data from an input device. Output dichroic mirrors synthesize the modulated RGB light components and project the image onto a viewing screen.

To enhance the luminance of the liquid crystal projection panels, reflective LCD pixels are used. These systems, sometimes referred to as Liquid Crystal on Silicon micro-display (LCOS), utilize a large array of image pixels to achieve a high resolution output of the input image data. Each pixel of the display includes a liquid crystal layer sandwiched between a transparent electrode and a reflective pixel electrode. Typically, the transparent electrode (sometimes called the ITO layer) is common to the entire display while the reflective pixel electrode is operative to an individual image pixel. A storage element, or another type of memory cell, is located beneath each of the pixels and is operative to direct a voltage on the pixel electrode. By controlling the voltage difference between the common transparent electrode and each of the reflective pixel electrodes, the optical characteristics of the liquid crystal can be controlled according to the image data being supplied. Generally, the optical characteristics of liquid crystal materials are responsive to an applied voltage. The storage element can be either an analog or a digital storage element. More and more often, digital storage elements, in the form of static memory are being used for this purpose.

The liquid crystal layer modifies the polarization state of light that passes through it. In digital systems utilizing nematic liquid crystals, the extent of the modification to the state of polarization of incident light depends on the root-mean-square (RMS) voltage that is applied across the liquid crystal layer. The intensity of the reflected light depends therefore on the proportion of reflected light that is orthogonal to the polarization state of the incident light. (Sometimes referred to as "on state" light.) This value is in turn determined by the voltage being applied to the pixel electrode by the storage element, such being well known to those of ordinary skill in the art.

Therefore, by applying varying voltages to the liquid crystal material, the liquid crystal device can be configured to return varying amounts of "on state" light. When controlled by a digital storage element that can supply one of two possible instantaneous voltages to the pixel electrode, the liquid crystal material will respond in one of two principal ways, depending on the material. In the first instance, where the liquid crystal response time is much faster than changes to the drive waveform, the polarization state encoded into the reflected beam will closely follow the original drive waveform. In the second instance, where the liquid crystal response time is much slower than the changes to the drive waveform, the polarization state encoded into the reflected beam of light will follow the RMS of the applied voltages. In either instance the liquid crystal acts as a variable optical retarder, rotating some, all, or none of the incident polarized light, resulting in a varying intensity of the reflected beam of light once analyzed by a polarizing device. A human observer looking at the beams of light created by such devices will tend to average the intensities over a time scale of 15 to 30 milliseconds. Thus either modulation result can be resolved by human observers as gray scale images, provided the time frames for the different intensities are suitable short in duration. Finally, by varying the amount of time that the pixel is either "white" or "black," the human eye will perceive a gray scale shading somewhere between totally white and totally black.

Gray scale modulation may be used in a display to permit the display of a full range of colors. As is well known in the art, a reasonably complete range of colors can be created by combining the primary colors (red, green and blue) in varying intensities. The total number of different colors that can be created are determined by the number of gray levels that are available in a given color generation system. The gamut of the colors that can be created is determined by the spectral composition of the individual primaries. Thus the generation of gray levels in a pixilated display is a critical element in the capability of such a system to generate realistic images.

Pulse-width-modulation (PWM) is a method of driving these types of digital circuits to create gray scale. In one type of PWM, varying gray scale levels are represented by multi-bit words (i.e. a binary number). These multi-bit words are converted into a series of pulses. The time averaged RMS voltage corresponds to a specific voltage necessary to maintain a desired gray scale.

Another method for creating gray scale is binary-weighted pulse-width-modulation, where the pulses are grouped to correspond to the bits of a binary gray scale value. The resolution of the gray scale can be improved by adding additional bits to the binary gray scale value. For example, if a 4 bit word is used, the time in which a gray scale value is written to each pixel (frame time) is divided into 15 intervals. This results in 16 possible gray scale values ($2^4$ possible values). An 8 bit binary gray scale value would result in 255 intervals and 256 possible gray scale values ($2^8$ possible values).

In addition to controlling the RMS voltage that is seen by the liquid crystal material in each of the display pixels, modulation schemes may be incorporated that control how the specific data is written to the display imager (as opposed to how each pixel reacts to the supply voltage). Liquid crystal imagers consist of a series of pixel rows, and known systems write data to the imager one row at a time, typically beginning with the top row of the imager and sequentially progressing through all of the rows in the display. For example, in a VGA display that has 480 rows of pixels, and 640 pixels per row, a known modulation scheme would write data to each of the pixels in the first (i.e. top) row, and then progress to the next row in line and write data to each of the pixels in that next row. This scheme repeats until all 480 rows have been written. The process then repeats from the first row, updating the data reflected in each pixel depending on the image that is to be displayed. Under this known scheme, an individual pixel value is changed once every n row write times, where n is the number of rows in the imager (e.g. 480 rows in a VGA system). With the current level of resolution that LCD displays are achieving (i.e. 2000.times.1000 pixels in a HDTV scheme), the amount of time that a pixel waits to be rewritten is drastically affected in these once through write schemes.

In known systems using pulse width modulation, a higher imager write frequency improves the modulation efficiency, since the data for each pixel can be updated more frequently. However, the time that each bit of data is displayed also needs to be controlled and thus higher frequency systems do not always solve the control problem. Furthermore, higher speed driving circuits are inevitably more expensive and draw more power from the system, factors that are undesirable in the design of such circuits.

Another way to improve the modulation efficiency is to lower the frame rate of the system. However, this solution will significantly aggravate flicker issues in the display, another undesirable effect. It is therefore desirable to increase the imager write frequency in a display without increasing the frequency of the driving circuit and without increasing the system power consumption.

Both digital and analog modulation schemes suffer from lateral field defects, where two adjacent display pixels, one at a high voltage and one at a low voltage, have a very high pixel-to-pixel (i.e. lateral) field strength. This lateral field strength is commonly on the order of 10 times the vertical field strength. Since the two adjacent pixels represent a black to white, or dark to light, transition, the lateral field, which highlights the transition, is not a strong visual artifact and ultimately distorts the image. Notably, the transition between the two adjacent pixels (the edge) will be enhanced and the image will not appear as clear.

In this situation, digital modulation schemes are even more severely constrained because gray levels in adjacent pixels can produce lateral field effects (pixel-to-pixel) that are high enough to overpower the desired vertical field effect (pixel-to-ITO). The vertical field effect is what ultimately determines what gray scale value is displayed through the pixel. For a digital modulation scheme that utilizes simple binary weighted pulse width modulation, objectionable lateral field contours (defects) occur, for example, where adjacent pixels are driven at the mid gray levels 7 f and 80 (100% pixel-to-pixel temporal intermodulation), at ¼ gray levels 3 f and 40 (50% pixel-to-pixel temporal intermodulation), and at ⅛ gray levels if and 20 (25% pixel-to-pixel temporal intermodulation). These represent instances where the data in adjacent pixels are out of phase to the degree indicated and where the inter-pixel modulation lines resulting from the lateral fields stand out in sharp contrast to the modulation levels of the two pixels. While thermometer based codes can ameliorate the digital-unique lateral field effects with an increased frequency and an increased number of time divisions (normally a 2.times. improvement for 2.times. increase in bandwidth), this also aggravates the modulation efficiency because there is a trade off with the lateral field defects. See Yang, et al. IBM Journal of Research and Development, Volume 42, Number 3/4, May/July 1998, pp. 405-407, the contents of which are incorporated herein by reference, for an additional description of lateral field effects and reverse-tilt disclinations in nematic liquid crystal displays.

The inherent characteristics of liquid crystal materials also affect the modulation efficiency of these displays. For instance, reverse twists (multi-second smoke trails) limit the use of imagers that are based on either analog or digital modulation techniques. Known digital modulation schemes are more demanding on the liquid crystal material for reverse twist tolerances because of the higher driving voltages for use with common drive schemes. This also results in a reduced modulation efficiency.

Additionally, both analog and digital modulation schemes can suffer from flicker effects due to the use of low-frequency ITO drive schemes. The flicker frequency equates to half of the ITO-inversion rate. While this can have a more drastic effect on analog systems, digital pulse width modulation schemes result in a non-linearity in the digital code to RMS voltage mapping. This can both help and hurt the electro-optical curve linearization.

The modulation efficiency in known digital systems is limited for several reasons. First, the pixel voltage ($V_1$) is turned off (i.e. not modulating a full white value) during the period of time the imager is being written with the next portion of the binary weighted data. $V_1$ is then pulsed for the time associated with the next portion of the binary weighted data. This process repeats to write each portion of the image data. The limited time frame during which the write function can take place limits the modulation efficiency.

Second, even though applying an overlap of array-write and liquid crystal voltage drive improves the modulation efficiency, increased thermometer decoding limits the overlapped write improvements. Lowering the frame rate (rather than the peak frequency) also improves the modulation efficiency, but can significantly aggravate display flicker issues.

Third, known methods of gray scale modulation are suboptimal. For gray scale modulation, known digital displays typically write every row or write the entire display and then sequence the display so that there are two storage registers for each pixel. The display writes the first register and strobes the data to bring forward the second register to display it on the pixel. Unfortunately, this approach creates a problem whereby for the least significant bit (LSB) or lowest gray scale value, the write time for the display may be longer than the duration of the LSB. So the display ends up writing the LSB and then may have some time which is dead before they can rewrite the display.

SUMMARY OF THE PRESENT INVENTION

The present invention provides methods, systems, and apparatus for improved gray scale modulation. More specifically, the present invention uses spacing of row write actions on a display to create gray scale modulation. In one embodiment, a scheme is provided for modulating a liquid crystal display by use of a system of write pointers to cause the modulation of rows to result in the generation of gray scale on the image. The present invention is based in part on the principle that a row-write function establishes a gray scale modulation state that remains in place until a new set of gray scale data is written to that same row. By controlling the writing of new data states, gray scale modulation may be achieved. Additionally, the present invention may deal with each row individually. Improved modulation efficiency may allow the use of lower frequency imaging circuits to achieve the same display image. At least some of these and other objectives described herein will be met by some embodiments of the present invention.

In one embodiment, the present invention provides a method of modulating a display, the display having a first imaging section and a second imaging section, wherein each of the imaging sections has a plurality of rows. The method comprises modulating a first row in the first imaging section and modulating a first row in the second imaging section. In some embodiments, the data writing may alternate between the first imaging section and the second imaging section and progresses sequentially through all of the rows in each imaging section. Additionally, in other embodiments, after writing data to all of the rows in the first imaging section, data may be written to the first row in the second imaging section, and wherein after writing data to all of the rows in the second imaging section, data is written to the first row in the first imaging section.

In one aspect of the present invention, modulating the first row in the first imaging section and modulating the first row in the second imaging section may comprise receiving a signal from a data source; and applying a root mean square voltage to a first one of the plurality of pixel elements; wherein the root mean square voltage is based on the value of the signal. In another embodiment, for reason of artifact mitigation, for the higher level bits we exercise a different option, where the bits are equally weighted so that we map the binary weighted bits into a set of non-binary weighted bits. The mapping may be into a set of binary weighted and non-binary weighted bits of various lengths.

In another embodiment of the present invention, a method of modulating a display is provided. The method comprises partitioning the display into at least two virtual imaging sections, wherein each of the imaging sections has a plurality of rows; ascertaining a first data value; modulating the first data value onto a first virtual imaging section; ascertaining a second data value; and modulating the second data value onto a second virtual imaging section.

In yet another embodiment of the present invention, a method is provided for modulating a display. The method comprises using row write actions to write data to a plurality of rows of pixel elements on the display. The spacing of row write actions on the display is used to create gray scale modulation, wherein one spacing between sequential row write actions is at a first distance while another spacing between sequential row write actions is at a distance greater than said first distance. The spacing between row write actions may create binary weighted gray scale modulation. In another embodiment, the spacing between row write actions creates a binary weighted gray scale modulation in linear order. In yet another embodiment, the spacing between row write actions creates binary weighted gray modulation in other than linear order. Still other schemes are possible such as where the spacing between row write actions creates a gray scale modulation scheme with both binary and non-binary weightings and where more than one set of modulation planes can create some intermediate bit weightings or where the spacing of row write actions creates a set of gray scale bits of binary weighting for lower gray levels and a set of gray scale bits of other than binary weighting for higher gray levels. In another embodiment, the method comprises using spacing and direction of row write actions on said display to create gray scale modulation, wherein said row-write actions do not proceed sequentially from adjacent row to adjacent row from top to bottom.

In a still further embodiment of the present invention, a method of modulating a display having a plurality of rows of pixels is provided. The method comprises writing data to a plurality of pixels in a first row; writing data to a plurality of pixels in a second row; and writing data to a plurality of pixels in a third row. The distance between first and second row is different from a distance between the second row and the third row, the distances selected based on a predetermined scheme for creating gray scale modulation.

In another embodiment of the present invention, a device is provided for displaying an image. The device comprises a display having a plurality of rows for displaying visual information. The display uses a modulation scheme wherein spacing of row write actions on the rows creates gray scale modulation, wherein one row spacing between sequential row write actions is at a first distance while another row spacing between sequential row write actions is at a distance greater than said first distance.

In another embodiment of the present invention, the display uses a modulation scheme wherein spacing and direction of row write actions on the rows creates gray scale modulation according to a predetermined scheme. The row write actions may be sequential and on nonadjacent rows.

In a still further embodiment, certain spacing or a certain number of write pointers are used in order to create gray level. In one embodiment, for a given point, when the write pointer crosses that point, it sets the data for that row and that data remains as it is until the next write pointer arrives. The time between that determines a certain gray scale difference. If that's one LSB then that's the least level of gray level. Embodiments may also be designed to incorporate more than one write pointer. Having more than one write pointer on the screen has several benefits. One benefit is that it controls the overall bandwidth requirement of the system. If there is only one write pointer, then we would be writing the entire display from top to bottom and then we would have to come back and overwrite it again. In one embodiment, an efficient scheme would be if every gray level were represented by a power of 2.2(0), etc. . . . so that the spacing are proportional to that. In some embodiments, modulation efficiency is increased allowing the use of lower frequency imaging circuits to achieve the same display image. Some embodiments of the write/row method described herein reduce total bandwidth required and may eliminate the difficulty of the LSB time being shorter than the time.

In another embodiment of the present invention, a device is provided comprising a display having a plurality of rows for displaying visual information. The display may use a modulation scheme wherein spacing of a plurality of row write actions on the rows creates gray scale modulation, wherein the spacing includes a mix of binary and non-binary weightings.

A further understanding of the nature and advantages of the invention will become apparent by reference to the remaining portions of the specification and drawings.

BRIEF DESCRIPTION OF THE DRAWINGS

FIG. 13*b* is a chart demonstrating add bit-weight calculation for the LSB of a binary weighted modulation scheme for a display.

DETAILED DESCRIPTION OF THE INVENTION

It is to be understood that both the foregoing general description and the following detailed description are exemplary and explanatory only and are not restrictive of the invention, as claimed. It should be noted that, as used in the specification and the appended claims, the singular forms "a", "an" and "the" include plural referents unless the context clearly dictates otherwise. Thus, for example, reference to "a material" may include mixtures of materials, reference to "a display" may include multiple displays, and the like. References cited herein are hereby incorporated by reference in their entirety, except to the extent that they conflict with teachings explicitly set forth in this specification.

In the following description we will make use of the term "write pointer". A write pointer points to a row on the display which has a particular row spacing relationship to the rows below and above it which are also pointed to by write pointers. The locations of a set of write pointers are not fixed but rather move in a linear fashion according to a predetermined scheme. This movement of write pointers is essential to the creation of gray scale in images after the present invention. This first class of write pointers may be called virtual write pointers, but may be referred to without specific use of the term "virtual." The distinction is clear to those skilled in the art. A second class of write pointers is referred to as physical write pointers. In one embodiment, the physical write pointer may service the virtual write pointers in turn. The terms "row" and "row write actions" as used herein are not limited to horizontal orientations and may be used to included lines at a variety of orientations, including vertical and those other than horizontal.

Figure 1A:
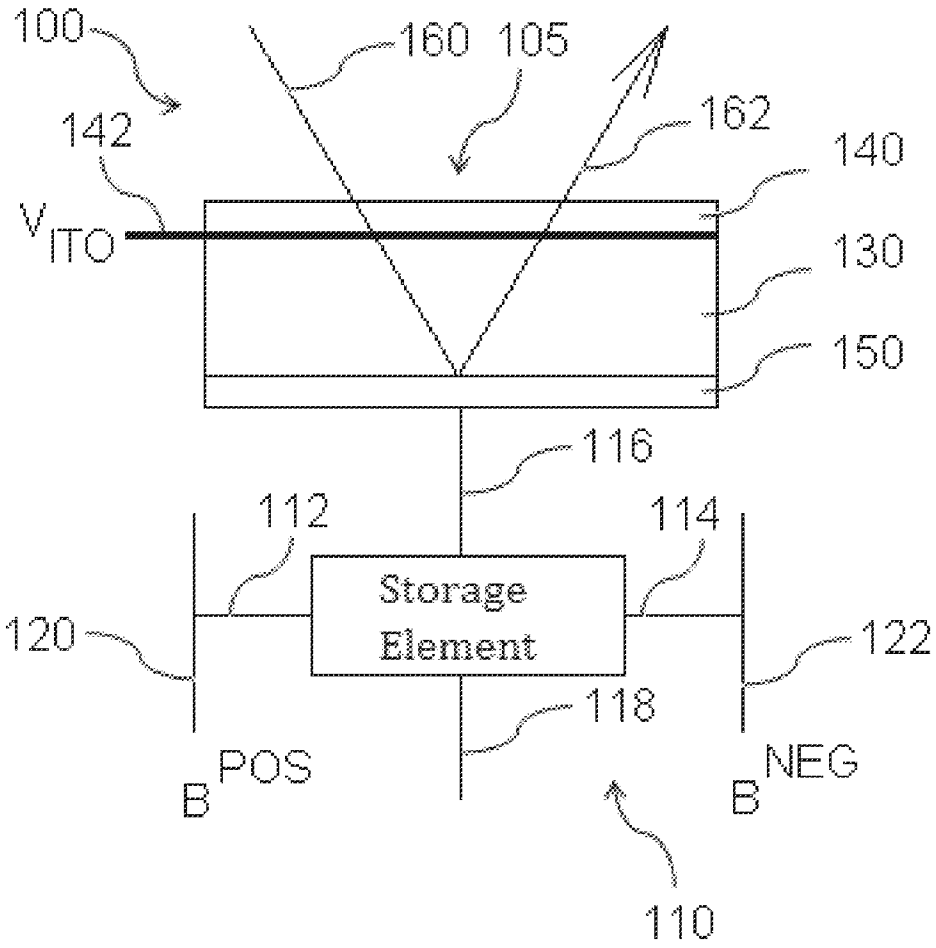
FIG. 1A is a block diagram of a single liquid crystal pixel cell that utilizes a reflective pixel electrode.
Figure 2:
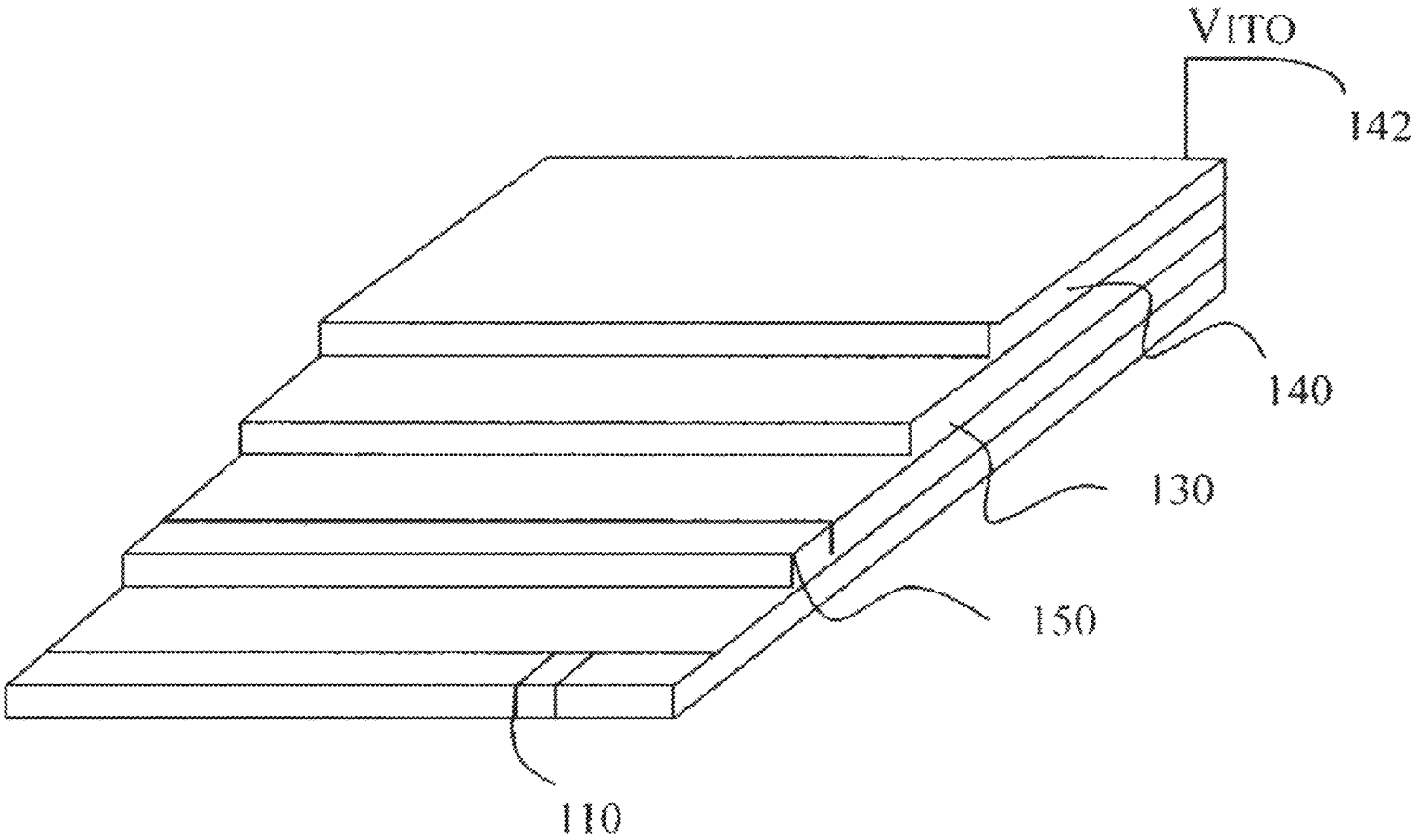
FIG. 2 is a perspective view of a liquid crystal on silicon display panel.

FIGS. 1A and 2 show one embodiment of a liquid crystal on silicon (LCOS) micro-display panel 100. A single pixel cell 105 includes a liquid crystal layer 130 in between a transparent common electrode 140, and a pixel electrode 150. A storage element 110 is coupled to the pixel electrode 120, and includes complementary data input terminals 112 and 114, a data output terminal 116, and a control terminal 118. The storage element 110 is responsive to a write signal placed on control terminal 118, reads complementary data signals asserted on a pair of bit lines ($B_{POS}$ and $B_{NEG}$) 120 and 122, and latches the data signal through the output terminal 116. Since the output terminal 116 is coupled to the pixel electrode 150, the data (i.e. high or low voltage) passed by the storage element 110 is imparted on the pixel electrode 150.

The pixel electrode 150 may be formed from a highly reflective polished aluminum. In an LCD display panel in accordance with the present invention, a pixel electrode 150 is provided for each pixel in the display. For example, in an SXGA display system that requires an array of 1280.times.1024 pixels, there would be an individual pixel electrode 150 for each of the 1,310,720 pixels in the array. The transparent common electrode 140 is a uniform sheet of conductive glass may be made from Indium Tin-Oxide (ITO). A voltage ($V_{ITO}$)) is applied to the common electrode 140 through common electrode terminal 142, and in conjunction with the voltage applied to each individual pixel electrode, determines the magnitude and polarity of the voltage across the liquid crystal layer 130 within each pixel cell 105 in the display 100. Depending on the root-mean-square (RMS) voltage that is applied across the liquid crystal layer 130 of each pixel cell 105, an incident light beam 160 that is directed at the pixel cell 105, passes through the transparent common electrode 140 and the direction of its polarization vector is changed by the liquid crystal material 130. Nematic liquid crystal devices may be thought of as variable optical retarders in that the degree of birefringence and rotation of incident polarized light varies as a function of the voltage applied across the liquid crystal cell. The incident light may be substantially linearly polarized and the reflected light may be more elliptically polarized with a substantial linearly polarized component at some angle relative to the incident polarized light. For purposes of the following discussion only the rotation effects are discussed with the understanding that the other effects still may be present. The degree of rotation is dependent on the RMS voltage applied across the liquid crystal. A voltage applied across the liquid crystal material 130 affects the degree to which the liquid crystal material will rotate incident polarized light and transmit light. For example, applying a certain voltage across the liquid crystal material 130 may only partially rotate the incident light to be reflected back through the liquid crystal material and the transparent common electrode 140.

After passing through the liquid crystal material 130, the incident light beam 160 is reflected off of the pixel electrode 150 and back through the liquid crystal material 130. The intensity of an exiting light beam 162 is thus dependent on the degree of rotation imparted by the liquid crystal material 130, which is subsequently dependent on the voltage applied across the liquid crystal material 130.

The storage element 110 may be formed from a CMOS transistor array in the form of an SRAM memory cell (i.e. a latch), but may also be formed from other known memory logic circuits. SRAM latches are well known in semiconductor design and manufacturing and provide the ability to store a data value, as long as power is applied to the circuit. Other control transistors may be incorporated into the memory chip as well.

The physical size of a liquid crystal display panel utilizing pixel cells 105, is largely determined by the resolution capabilities of the device itself as well as industry standard image sizes. For instance, an SVGA system that requires a resolution of 800.times.600 pixels requires an array of storage elements 110 and a corresponding array of pixels electrodes 150 that are 800 long by 600 wide (i.e. 48,000 pixels). An SXGA display system that requires a resolution of 1280.times.1024 pixels, requires an array of storage elements 110 and a corresponding array of pixels electrodes 150 that are 1280 long by 1024 wide (i.e. 1,310,720 pixels). Various other display standards may be supported by a display in accordance with the present invention, including XGA (1024.times.768 pixels), UXGA (1600.times.1000 pixels), and high definition wide screen formats (2000.times.1000 pixels). Any combination of horizontal and vertical pixel resolutions is possible, the precise configuration being determined by industry applications and standards. Since the transparent common electrode 140 (ITO glass) is a single common electrode, its physical size will substantially match the total physical size of the pixel cell array with some margins to permit external electrical contact with the ITO and space for gaskets and a fill hole to permit the device to be sealed after it is filled with liquid crystal.

Figure 1B:
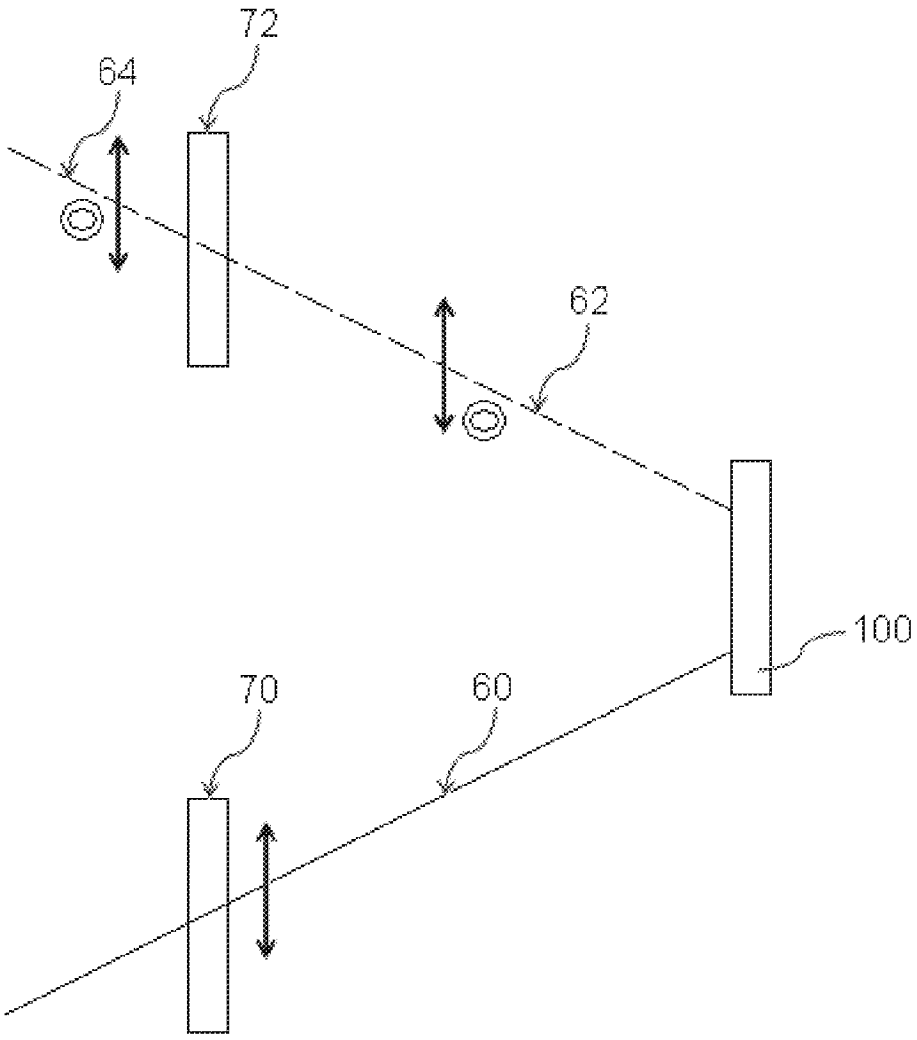
FIG. 1B is a block diagram of a simple projection system that utilizes a reflective liquid crystal microdisplay.

FIG. 1B depicts the polarization states of light in a simplified liquid crystal on silicon projection device. All refractive and diffractive optical components, such as lenses, have been deleted for purposes of clarity. Incident beam of light 60 passes through linear polarizing element 70, thus insuring that the light incident on display panel 100 is substantially linearly polarized. Panel 100 is driven to a voltage state or states after the previous discussions, and, as a result, reflects beam of light 60 and modifies the polarization state of incident light beam 60 into the elliptically polarized light state of beam 62. Beam of light 62, in its exit path, passes through second linear polarizer 72. Linear polarizer 72 modifies the reflected and elliptically polarized beam of light 62 into substantially polarized beam of light 64. It is well known to those experienced in the art that linear polarizers 70 and 72 may be substantially orthogonal to achieve best system contrast.

Figure 3:
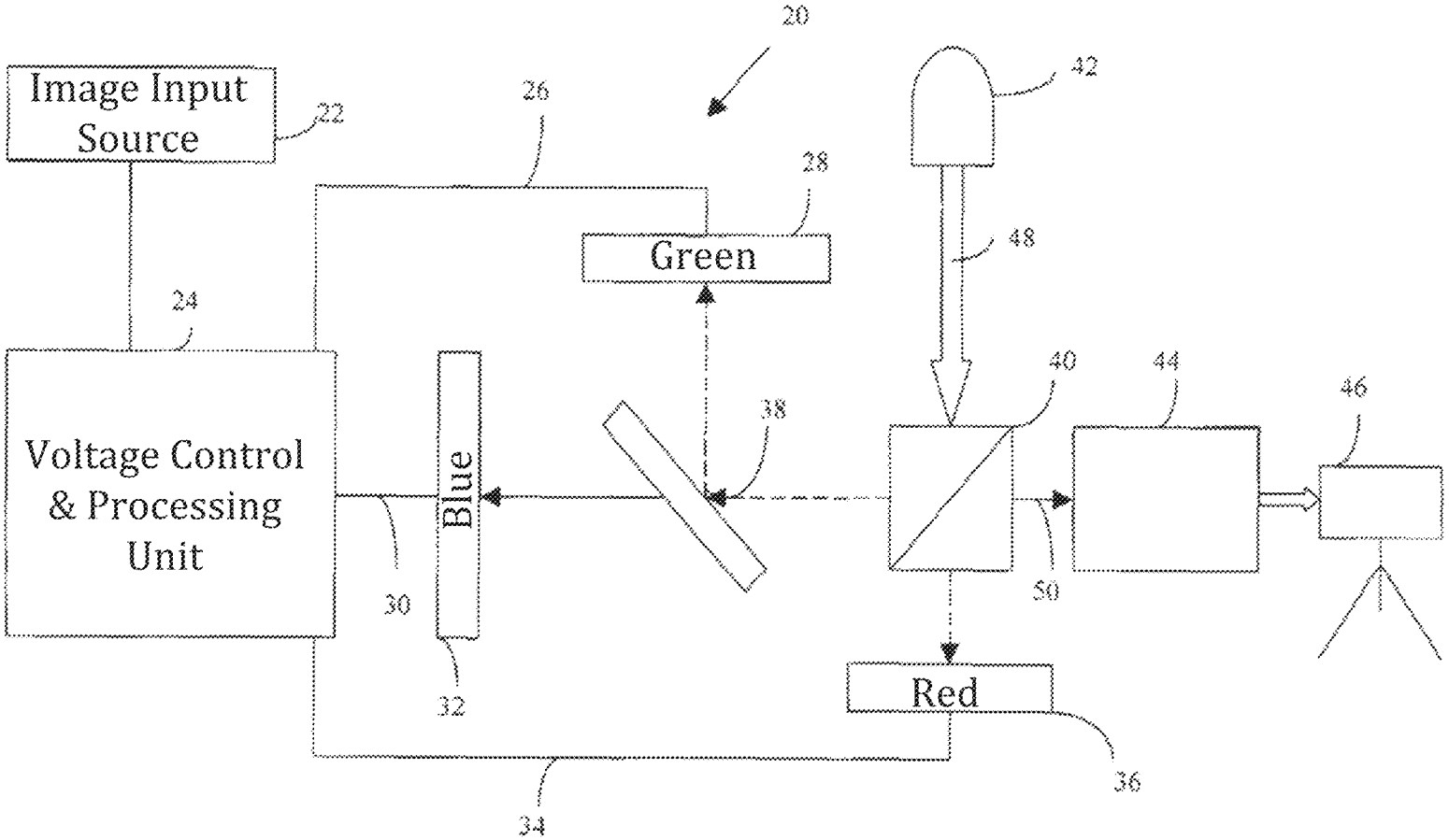
FIG. 3 is a diagram of a projection display system utilizing liquid crystal display panels.

A typical projection display system 20 utilizing liquid crystal display panels, is shown in FIG. 3. Image data is received from an input source 22 such as a television cable or computer and is directed into a control unit 24. The control unit 24 provides such functions as voltage control, memory management, and data processing. In particular, the processing unit divides the image data received from the input source 22 into its red, green and blue components, including elements of shading and brightness. The green components are sent via data line 26 to a green LCD imager 28, the blue components are sent via data line 30 to a blue LCD imager 32, and the red components are sent via data line 34 to a red LCD imager 36. Each of the LCD imagers 28, 32, and 36 are physically equivalent, and are each designed to provide an appropriate gray scale resolution for each of the red, green, and blue colors from the data source.

A light source 42 directs white light, which contains each of the red, green, and blue components, at a first dichroic mirror 40. The red portion of the white light 48 is directed at the red LCD images 36, while the remaining green and blue portions of the white light are directed at a second dichroic mirror 38. The second dichroic mirror 38 separates the green and blue components of the remaining light and directed them at the green and blue LCD imagers 28 and 32 respectively. Each of the red, green, and blue LCD imagers reflects back the respective components of the white light according to the data they each received from the control unit 24.

The three components are reassembled as an output image 50 and are projected through a lens 44 onto a display surface 46. The electronic circuits used to drive these types of LCD circuits are more fully described in U.S. Pat. No. 7,443,374, filed on Apr. 15, 2003, and U.S. Pat. No. 7,468,717, filed on Dec. 26, 2002, fully incorporated herein by reference for all purposes. Similar optical architectures exist which separate color temporally through the use of devices such as color wheels rather than physically through dichroic splitter plates.

Figure 4A:
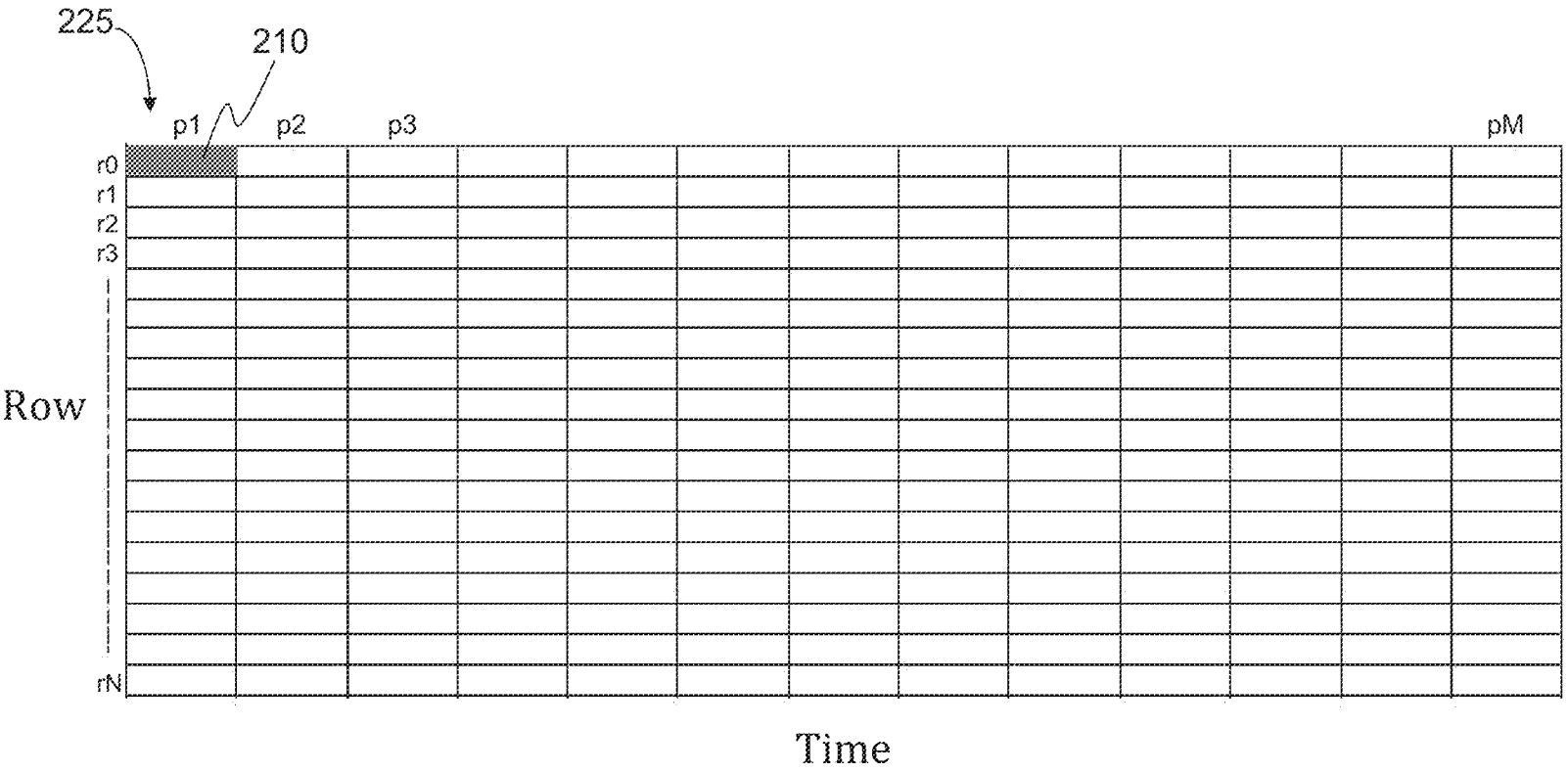
FIG. 4A is a diagram of the pixel arrangement of a display imager.
Figure 4B:
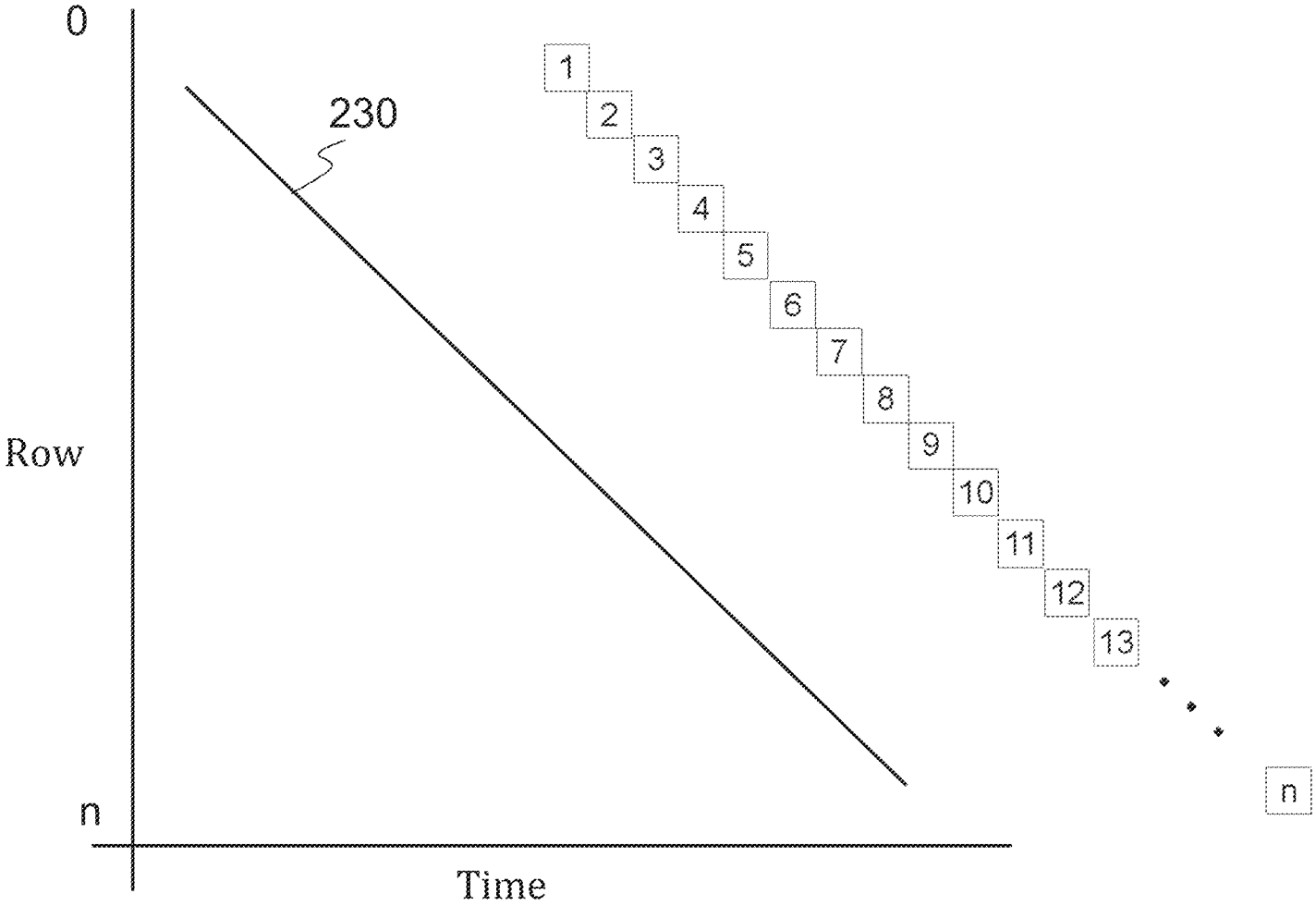
FIG. 4B is a graph representing the rate that a single imager write pointer progresses through an imager.

FIGS. 4A and 4B schematically represent a known LCD imager 225 (FIG. 4A) and a known pixel row writing scheme (FIG. 4B). The imager 225 is composed of an array of pixels 210, the number of such pixels being determined by multiplying the number of rows N by the number of pixels per row (M). In the example of FIG. 4A, the imager is divided into N rows, where each row has M pixels. Each pixel 210 is essentially identical and represents a discrete point of image data. FIG. 4B depicts the row versus time writing scheme of the imager represented in FIG. 4A. FIG. 4B illustrates how a known imager write scheme is implemented. In FIG. 4B each numbered box (1 through n) represents one pixel row in the imager.

Following the row write sequence in FIG. 4B, one row is written at a time, with the write sequence progressing sequentially through all of the rows of the imager beginning at the top (ri) of the imager and ending at the bottom (rN) of the imager. As the writing sequence of each row N is initiated, each of the pixels 210 in each row are written sequentially, one at a time, from left to right, beginning with pixel pl, and progressing through pixel pM. The time it takes each row to complete writing is the time it takes the system to sequentially write each of the pixels pl-pM in that particular row. The slope of line 230 represents the rate at which the rows in the imager 225 are written. A steeper slope indicates that a single row of the imager is "refreshed" or re-written, more often. As such, a steeper slope of line 230 means that the display produced by the imager is written once through at a faster rate. FIG. 4B depicts a modulation scheme that utilizes a single write pointer to write image data to the imager. Utilizing this scheme, a single pixel on the imager can only be rewritten (i.e. the data value is updated) when the single write pointer again reaches that point in the display. Once the write pointer has progressed through the entire display, the write pointer resumes at the top of the display.

As an example, if an imager system takes 0.41 microseconds (μsec) to write each row in an imager that has 1000 rows, it will take:

$$1000 \text{ rows} * 0.41\ \mu\text{sec/row} = 410\ \mu\text{sec}$$

to write every row of the imager once. Therefore, any individual element (pixel) on the imager can have its value changed no more often than once every 410 μsec. The rate at which each row in the display is written is a variable depending on the speed of the underlying system and the limitations of the circuitry that drives the display (e.g., the number of pixels that can be written each clock cycle).

Figure 5A:
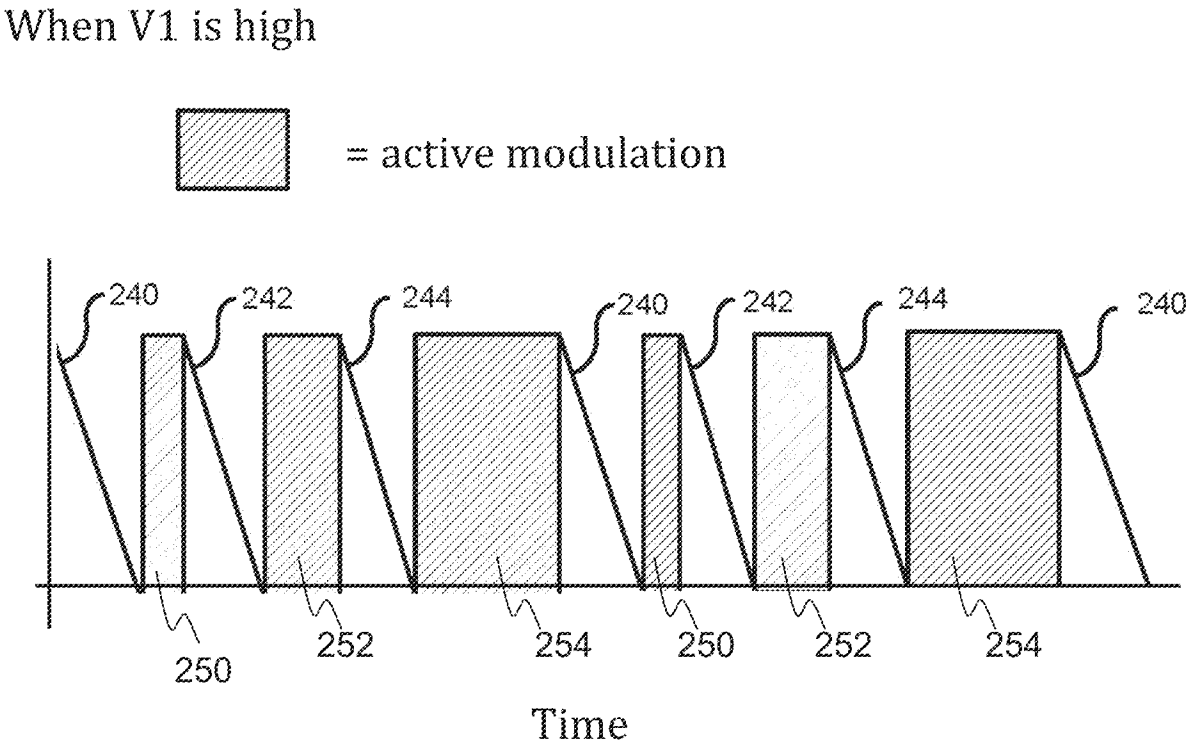
FIG. 5A is a graph representing the progression of a single imager write pointer through an imager operating under a thermometer based decoding scheme.
Figure 5B:
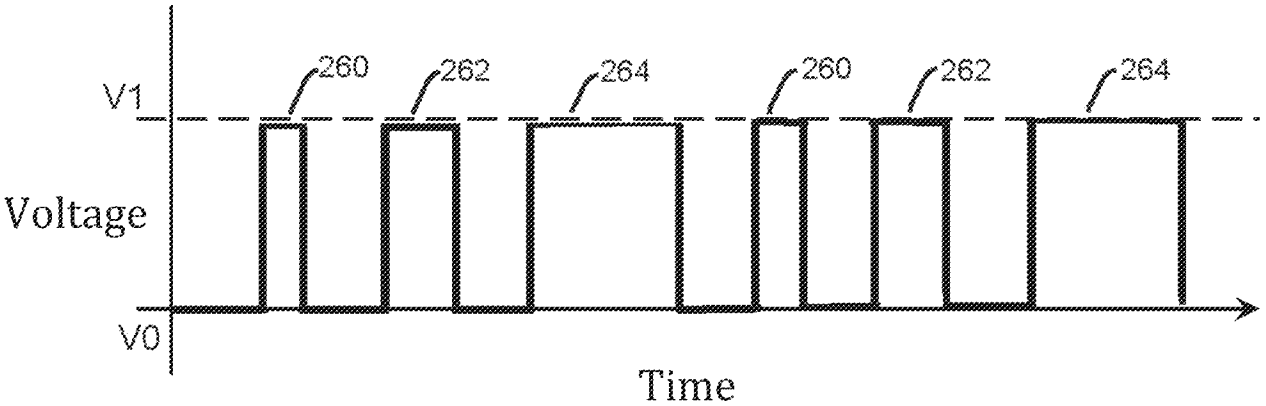
FIG. 5B is a graph representing the liquid crystal voltage levels corresponding to the imager write sequence of FIG. 5A.

FIGS. 5A and 5B schematically represent another known row/pixel writing scheme where increased thermometer decoding is used. Briefly, thermometer decoding consists of a series of equally weighted time values followed by a series of binary weighted time values. In the example of FIG. 4B, an increased number of non-overlapping sequential imager write pointers are utilized. In other words, only a single write pointer is "active" on the display at any given time. FIG. 5A shows the rate of row write pointers 240, 242, and 244, and the related time frames 250, 252, and 254 where active modulation occurs. FIG. 5B correlates the pixel voltage associated with each of the time sequences of FIG. 5A. Notably, modulation can only occur when the liquid crystal drive voltage is at a high state (i.e. vi), and does not occur during the write sequence of the pixel rows—where the write pointers 240, 242, and 244 are "active" on the display.

The modulation scheme shown in FIGS. 5A and 5B presents a time conflict between the imager write pointer load time and the active modulation time. Since the two events cannot happen during a common time interval, this limits the efficiency of this type of digital modulation scheme.

Figure 6A:
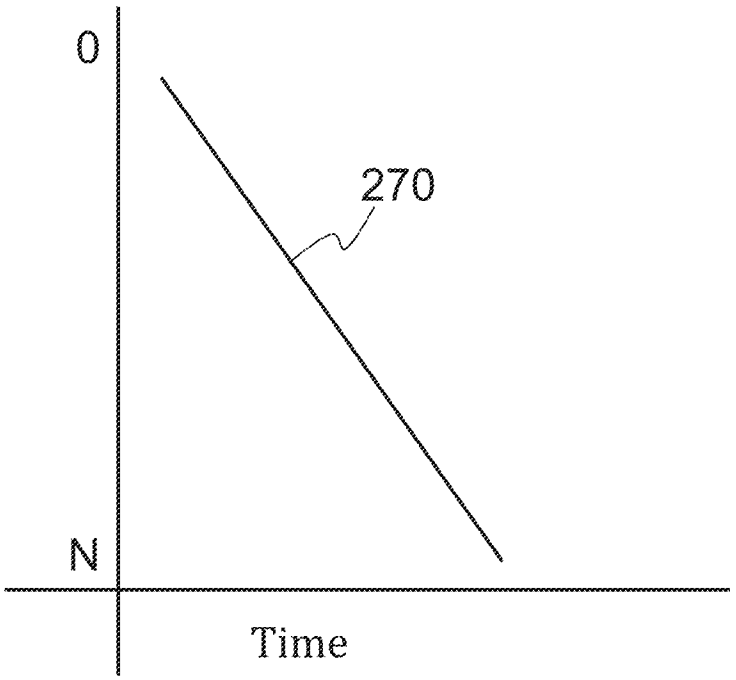
FIG. 6A is a graph representing the progression of a single write pointer in accordance with the present invention.
Figure 6B:
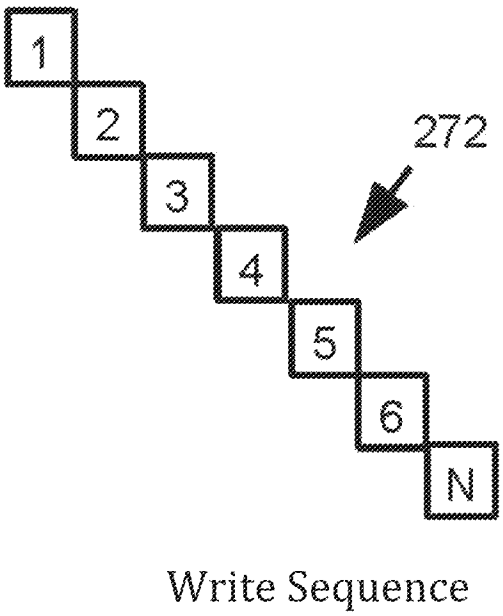
FIG. 6B is a representation of the row write sequence of the write pointer of FIG. 6A.

Referring to FIGS. 6A and 6B, a single write pointer 270 (FIG. 6A) and the corresponding row write sequence 272 (FIG. 6B) are shown. The write sequence of FIGS. 6A and 6B shows sequential row writes with a sequence as follows:

Cycle 1—write row 1
Cycle 2—write row 2
Cycle 3—write row 3
●
●
●
Cycle n—write row N This sequence continues through each of the rows in the imager. Since this scheme utilizes only a single write pointer, it advances through the display with a speed of:

$$\text{Single Row Write Time} = \#\text{ pixels in one row(pixels/row)}/32\text{(pixels/cycle)}/\text{imager frequency(cycles/sec)}$$

where "# of pixels in one row" represents the horizontal pixel resolution of the imager, namely the number of pixels in a single row on the imager. The numerical value "32" represents the number of pixels that can be written to the imager in a single 32 bit clock cycle. "Imager frequency" represents the speed of the imager clock that is driving the system. For example, in an imager that has 1408 pixels per row, it would take 44 clock cycles to write data to the entire row. If the imager clock frequency were 100 MHz (100,000,000 cycles/sec or $1*10^{-8}$ sec/cycle), it would take $44*10^{-8}$ seconds to write one row. If the imager had 1050 rows, it would take $462*10^{-6}$ seconds to write every pixel in the imager once through. Again, the above example assumes only a single write pointer.

FIGS. 6A and 6B are shown to illustrate the relation of a known bit-write scheme to one in accordance with the present invention. The write plane of the imager of FIGS. 6A and 6B, the distance and time between successive write pointers updating the same point on the display, is essentially the time it takes for the single write pointer to update the entire display.

Figure 7B:
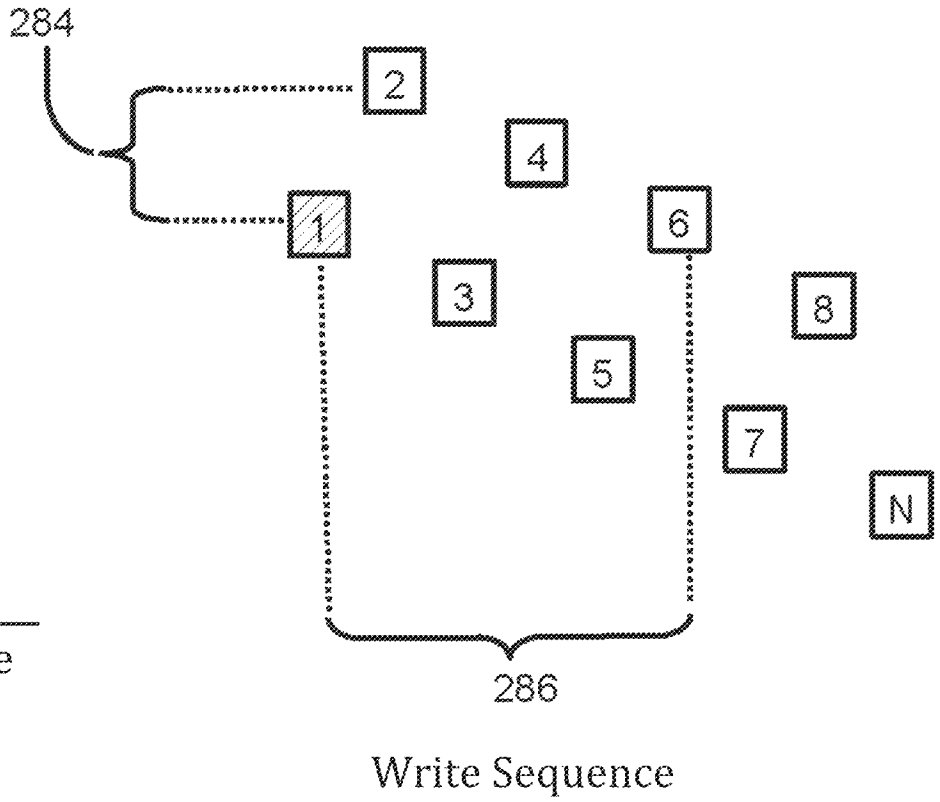
FIG. 7B is a representation of the row write sequence of the write pointers of FIG. 7A.
Figure 7A:
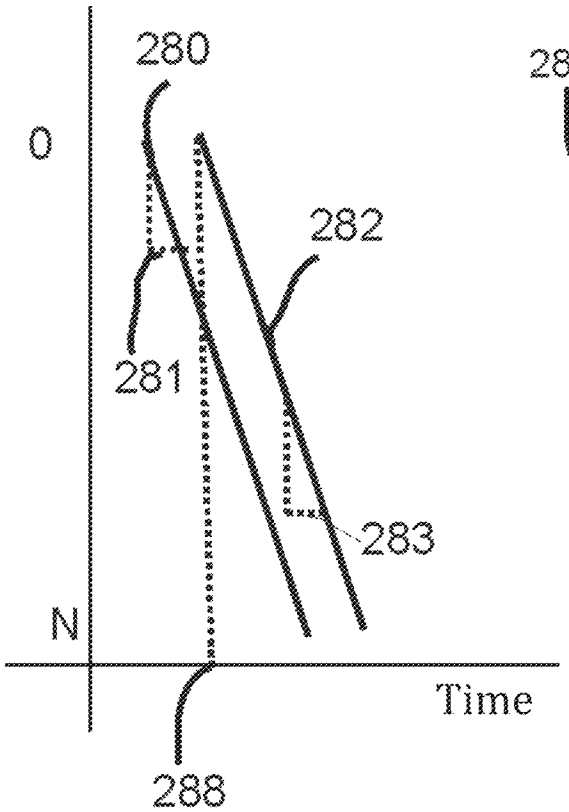
FIG. 7A is a graph representing the progression of two write pointers in a display in accordance with the present invention.

FIGS. 7A and 7B show a modulation scheme in accordance with the present invention that provides multiple write pointers that are active within the same imager. In one embodiment, the write pointers may be simultaneously active on the same imager. In another embodiment, more than one write pointer may be active on the screen at any given moment but are serviced in turn by the physical row-write scheduler. The use of multiple write pointers allows modulation to occur at several places on the imager without requiring a single write pointer to progress through the entire display. Data can also be refreshed while the write pointers are active. A scheme may be used whereby multiple write pointers are defined for a display device. Each write pointer corresponds to a bit plane of image data. A given set of bit planes has a relationship to a set of source image data. In other words, for this embodiment, each bit plane has a relationship to a gray scale level, and a given set of bit planes will create a particular gray level that corresponds to an image source data set.

The time and distance representations between the different write pointers are referred to as write planes. The write plane in the two write pointer embodiment is closer together in distance than the one write pointer embodiment. If each of the write pointers are addressable with low overhead, a second, third, or more write pointers can be created. The optimal number of write pointers is described in more detail below.

In FIGS. 7A and 7B, two overlapping write pointers are utilized rather than a single one. A first write pointer 280 progresses through the display with a velocity defined by a rate slope 281 and a second write pointer 282 progresses through the display with a velocity defined by a rate slope 283. In FIG. 7A, the two write pointers 280 and 282 are overlapping in time. For example, when the write time reaches a point 288, both of the write pointers 280 and 282 are simultaneously active on the imager. FIG. 7B shows the row-write sequence for the two write pointers 280 and 282. Each of the numbered boxes (1 through N) represents one pixel row in the imager and all pixels in that row. As seen from the row write sequence of FIG. 7B, the row-writes do not proceed sequentially through the imager rows from top to bottom. The speed that each write pointer progresses through the imager is different from a scheme that utilizes only one write pointer. With two write pointers, each write pointer (and thus teach write plane) advances through the display with a speed of:

Two Write Pointer Write Time=# pixels in two rows (pixels/row)/32(pixels/cycle)/imager frequency (cycles/sec)

or:

Velocity(2 write pointers)=Velocity(1write pointer)/2

Since the two write pointers are alternating writing their respective rows, twice as many pixels have to be written in order to complete writing a row in the display. From this embodiment, the above equation shows the relationship between the speed the write pointers move and the number of write pointers. Velocities may be in terms of rows per unit time. The velocity of course for the pointer depends on the clock because the clock determines how many pixels per clock can be written, which determines how long it takes to write a row.

In the present embodiment, if there a number of virtual write pointers, each one of those write pointers may be serviced in sequence. The sequence is the spacing between write pointers is not completely uniform. The spacing between lower order write pointers is binary weighted or may be binary weighted. And the spacing between upper write pointers may be rather than being binary weighted, may be uniformly weighted as will be discussed herein.

With two write pointers progressing through the display at the same time, a write plane is defined as the distance and time between the two write pointers. Each write pointer, and thus the intermediate write plane, in the embodiment of FIG. 7A advances at half of the velocity of the write pointer in the one write pointer embodiment.

In FIG. 7B, reference number 284 shows the value of the row-least significant bit (rLSB). The rLSB value 284 represents the number of rows contained in the least significant write plane and the least amount of time that a particular row will remain at a given value before its value is changed by a next write pointer passing that row. Reference number 286 shows the value of the time-least significant bit (tLSB). The tLSB value is the time value associated with two vertically adjacent rows' values being written with data. In the embodiment of FIGS. 7A and 7B, each write pointer is initiated with a load address to the alternate write pointer so that a sequence of row writing alternates between each of the write pointers that are active in the display.

Figure 8A:
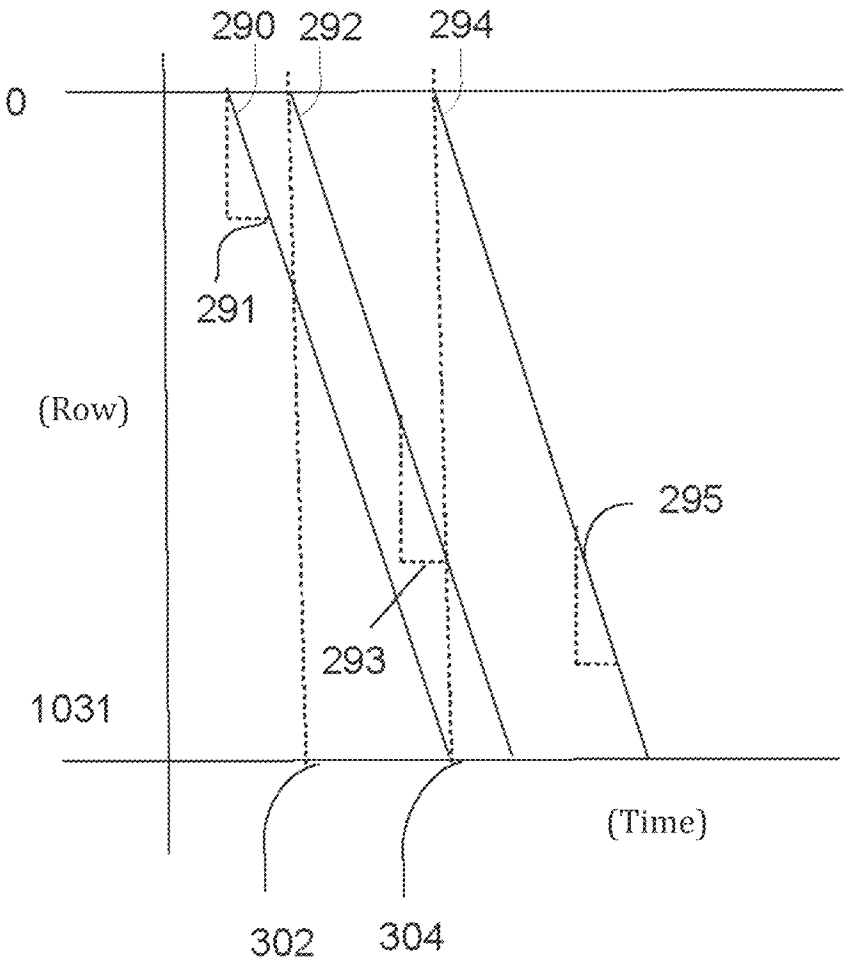
FIG. 8A is a graph representing the progression of three write pointers in a display in accordance with the present invention.
Figure 8B:
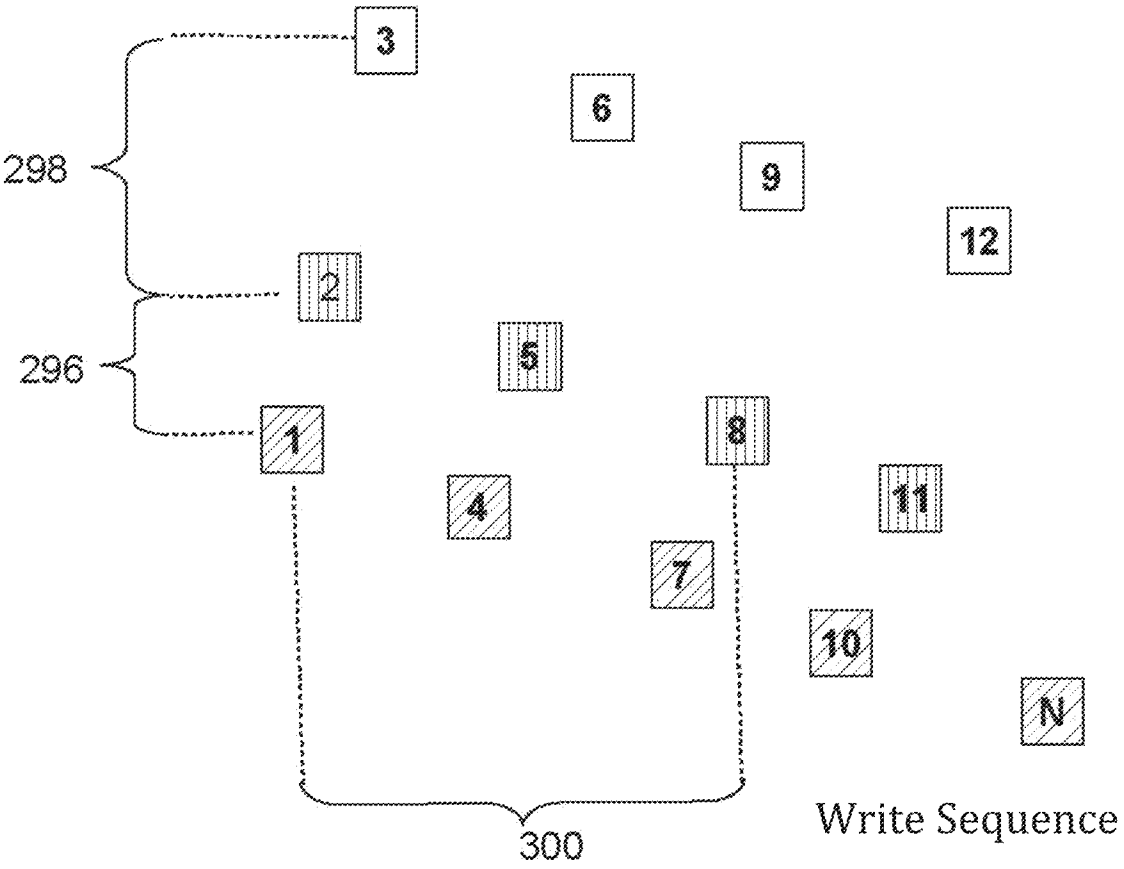
FIG. 8B is a representation of the row write sequence of the write pointers of FIG. 8A.

FIGS. 8A and 8B show a modulation scheme in accordance with the present invention that utilizes three overlapping write pointers 290, 292, and 294. FIG. 8A illustrates that the time (and thus distance) spacing of the three write pointers 290, 292, and 294 are not equal. Rather, the time-distance spacing of the write pointers follows a binary weighted scheme, where the distance between the second write pointer 292 and the third write pointer 294 is twice the distance between the first write pointer 290 and the second write pointer 292.

The first write pointer 290 progresses through the display with a velocity defined by a rate slope 291, the second write pointer 292 progresses through the display with a velocity defined by a rate slope 293, and the third write pointer 294 progresses through the display with a velocity defined by a rate slope 295. In FIG. 8A, the three write pointers 290, 292, and 294 are overlapping in time consistent with the binary weighted scheme described above. For example, when the write time reaches a point 302, each of the write pointers 290 and 292 are simultaneously active on the same imager. Similarly, when the write time reaches a point 304 each of the write pointers 292 and 294 are simultaneously active on the same imager.

FIG. 8B shows the row-write sequence for the three write pointers 290, 292, and 294. Each of the numbered boxes (1 through N) represents the writing of one row in the imager and all pixels in that row. As seen from the row write sequence of FIG. 8B, the row-writes do not proceed sequentially through the rows from top to bottom. The speed that each write pointer progresses through the imager is different than the one or two write pointer embodiments. With three write pointers, each write pointer (and thus each write plane) advances through the display with a speed of:

Three Write Pointer Write Time=# pixels in three rows(pixels/row)/32(pixels/cycle)/imager frequency(cycles/sec)

or $$\text{Velocity}_{(3\ write\ pointers)}=\text{Velocity}_{(1\ write\ pointer)}/3$$

Since the three write pointers are alternating writing their respective rows, three times as many pixels have to be written in order to complete writing a row in the display.

With three write pointers progressing through the display at the same time, there are three write planes defined, however, the display width of each of the write planes is not the same since the distance between each of the write pointers is defined by a binary weighted value. Each write pointer (and thus the intermediate write planes) in the embodiment of FIG. 8A advances at one third of the velocity of the one write plane embodiment of FIG. 6A.

In FIG. 8B, reference number 296 shows the value of the row-least significant bit (rLSB). The rLSB represents the number of rows contained in the least significant write plane and the least amount of time that a particular row will remain at a given value before its value is changed by a next write pointer that is passing that row. Reference number 298 represents two rLSB's, or the second value in the binary weighted scheme. Reference number 300 shows the value of the time-least significant bit (tLSB). The tLSB is the time value associated with two vertically adjacent rows~values being written with data. In the embodiment of FIGS. 8A and 8B, each write pointer is initiated with a load address to an alternate write pointer so that a sequence of row writing alternates between each of the write pointers that are active in the display.

The above embodiments can be extended to have a larger number of write pointers activated simultaneously. In accordance with the present invention, this technique has been extended in demonstration to up to 24 write pointers being simultaneously displayed. No specific limit on the number of write pointers exists. Rather the limit is established for a particular display resolution by the required bandwidth of the system and by the available memory within a particular instance of the controller system after this invention. The binary weighted distance between the various write pointers results in write planes that progress through the imager and update the data value of a given pixel row at a rate that is greater than that of a single write pointer, even though the velocity through the display of each write pointer in a multi-write pointer embodiment is slower than that of the single write pointer embodiment.

This technique effectively turns time into a distance by virtualizing the write pointers, in order to create a large number of write pointers. Each of the virtual write pointers moves forward with the same velocity (relative to the other write pointers simultaneously displayed). This velocity is a fraction of the maximum velocity that a single write pointer can advance. Therefore, setting the distance between each of the virtual write pointers sets the amount of time that any pixel stores its last written data.

Figure 9:
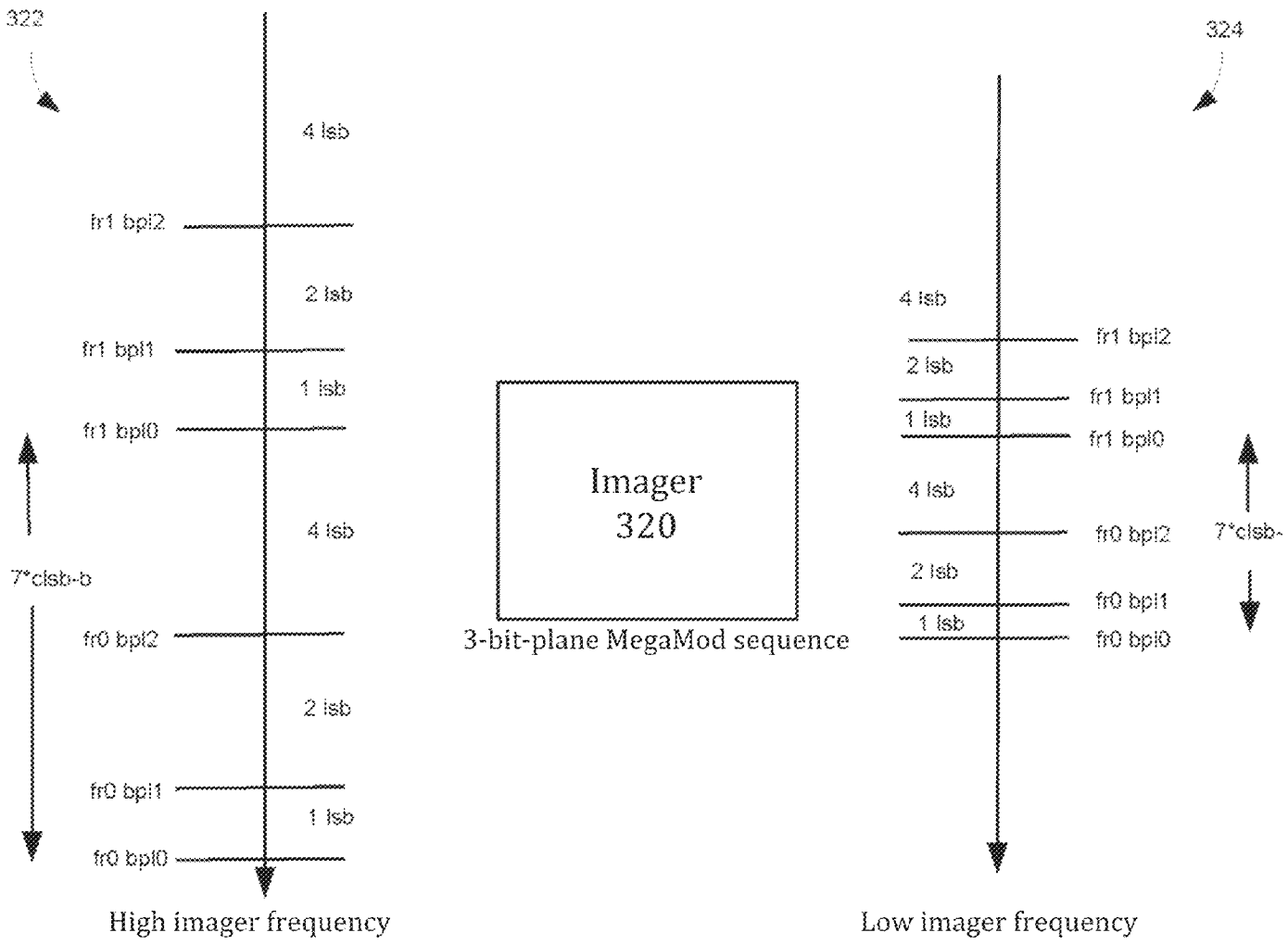
FIG. 9 shows a display in accordance with the present invention and the locations of a three write pointer modulation sequence on the imager window.

It is noted that the maximum number of virtual write pointers simultaneously displayed on the imager is not necessarily the same as the number of total write pointers available to the system. This results in several different possible write pointer velocity/imager frequency combinations. For instance, if the clock rate and therefore the rate of each write plane is increased, and since the time for any single element to display a particular value for time (t) is the distance between the two adjacent write pointers, there are rates (R) where the distance between the two pointers may be greater than the number of elements or rows on the entire imager. As the imager input frequency increases, the programmed distance (in whole rows) may increase correspondingly in order to maintain the same LSB time. As this "row distance" between pointers increases, a point is reached where another currently displayed write pointer "falls off" of the screen and is not active on the imager. FIG. 9 illustrates this feature. Imager 320 represents the physical size of an imager including its relation to the sequence of write pointers advancing across it. Write pointer sequence 322 shows the write pointer spacing with a high imager frequency and write pointer sequence 324 shows the write pointer spacing with a low imager frequency. Both sequence 322 and sequence 324 utilize a three write pointer modulation scheme. In the sequence 322, there are points in time where only one write pointer is active on the imager, and there are points in time where three write pointers are active on the imager. Similarly, in the sequence 324, there are points in time where four write pointers are active on the imager and there are points in time where there are six write pointers active on the imager. For a given LSB row distance, as the number of (peak) write pointers on the screen increases, the write speed may also increase in order to keep the forward velocity pointers (and thus the write planes) the same. This effect coupled with the number of write pointers on the screen at one time (which is a function of the write speed and therefore the frequency), leads to a nonlinear set of optimum frequencies for a given imager size, frame rate, and number of write pointers. As the number of pointers that are simultaneously active on the imager drops, the effective velocity of the pointer increases, resulting in several answers of frequency-velocity-number of pointer values in order to produce the same image.

Figure 10:
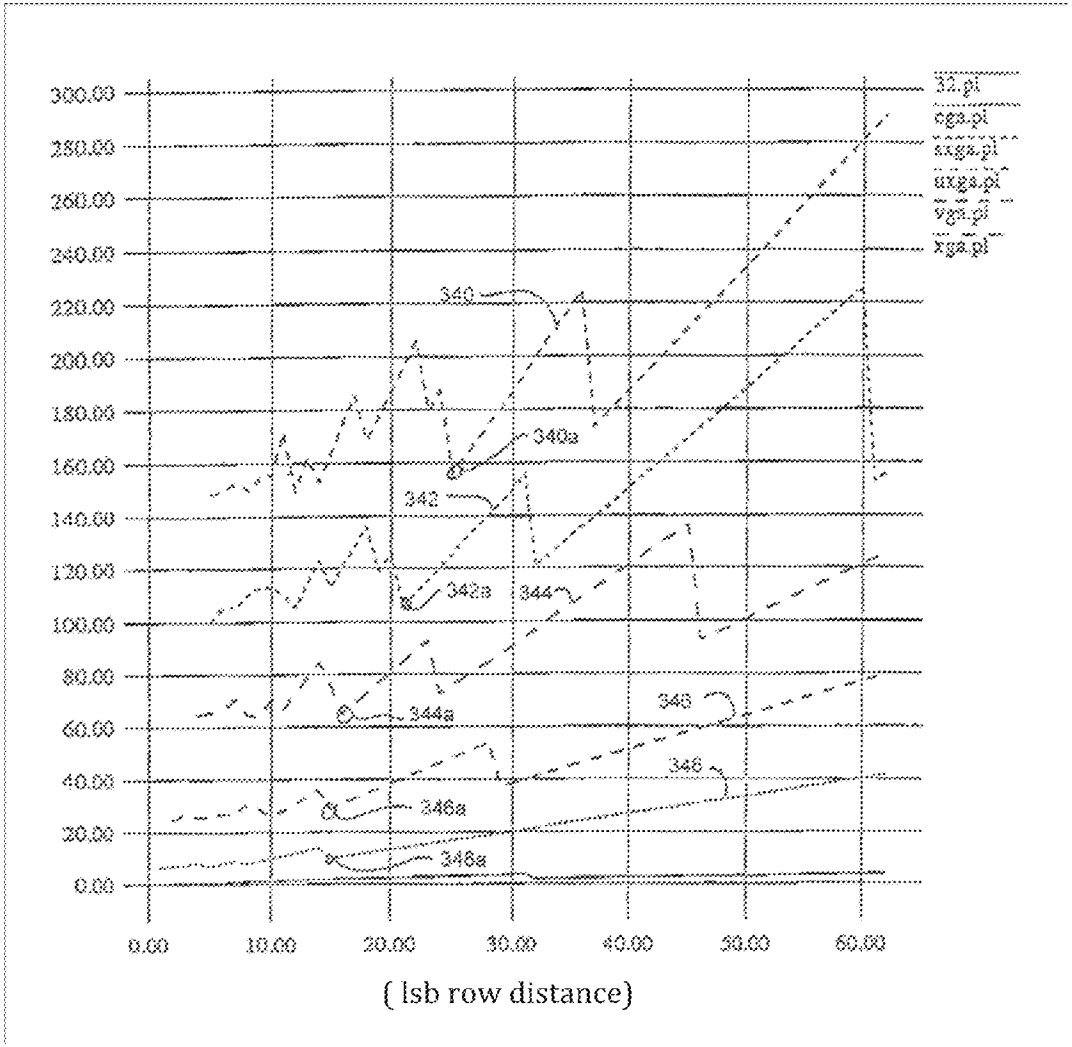
FIG. 10 is a plot of the imager frequency versus least significant bit row distance for various display systems.

FIG. 10 plots the LSB row distance against the imager clock frequencies for various imager sizes, including XGA, VGA, UXGA, SXGA, and CGA display resolution. Also included in the plot of FIG. 10 is a test imager size "32" which represents an imager with only 32 rows. Apparent from FIG. 10 is that there are a large number of combinations of imager frequencies and LSB row distances (i.e., anywhere along each of the respective line plots). It is preferable, however, to utilize lower frequency imagers since imaging hardware that runs at a lower frequency typically costs less to manufacture and requires less power. For instance, the low points for each of the plots in FIG. 10 would be optimum combinations for the system. (See e.g., points 340*a*, 342*a*, 344*a*, 346*a*, and 348*a*). While any point along the plot would be a workable combination, the lower frequency points lend the best application to systems manufactured in accordance with the present invention.

Figure 11:
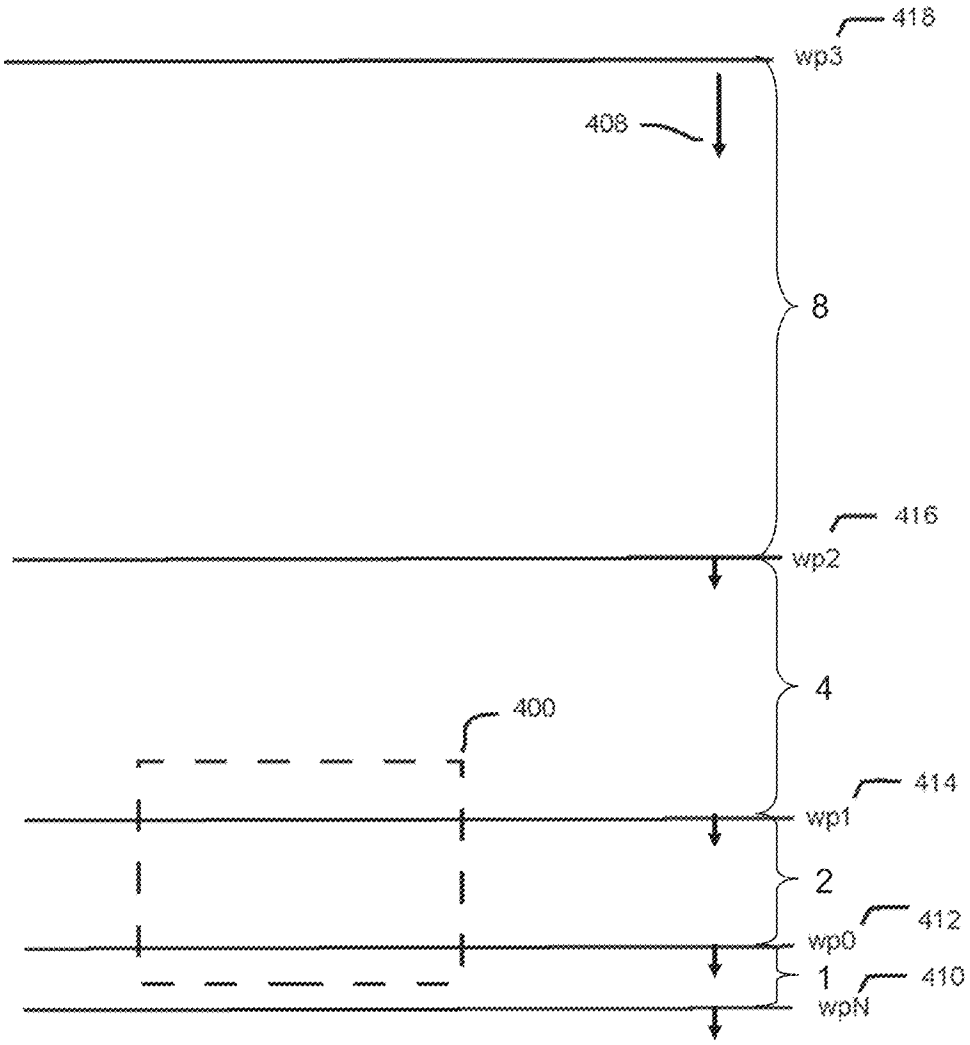
FIG. 11 shows a spatial representation of a row-write scheme where the motion of write pointers on a display is binary weighted and moves in a binary sequence or linear order.

Referring to the embodiment of FIG. 11, the motion and temporal spacing of a set of virtual binary-weighted write pointers relative to the face of a display device is depicted. Such a sequence of the motion of write pointers on display may be used with any of the methods and devices describe above. The virtual write pointers present on the face of the display 400 are serviced by a physical write pointer. It should understood, of course, that this row-write scheme may also be used with a system having a plurality of physical write pointers. The row-spacing of the motion of the write pointers is proportional to the binary weightings of the gray-scale values associated with that write pointer. The choice of row-write and row velocity is described above. In this instance, wpn 410 is the last write pointer of the previous modulation sequence. The spacing between wpn 410 and wp0 412 establishes the size of one "least significant bit" or LSB. In this embodiment, the spacing between wp0 412 and wp1 414 is double the number of rows between wpn 410 and wp0 412, thus creating a value of two LSBs. In like manner the spacing between write pointers wp1 414 and wp2 416 is double that of the spacing between write pointers wp0 412 and wp1 414, or four LSBs. In the final examples, the spacing between wp3 418 and wp2 416 is eight LSBs. With this combination of write pointers, it is possible to represent gray scale values from 0 to 15. Note that in this non limiting example, the binary weight values are in ascending and monotonic order, since those depicted above represent later modulations and each write pointer interval is larger than all those below it. The sequence of the weightings is $2^0$, $2^1$, $2^2$, $2^3$, and can be extended to a number of additional weightings.

Figure 12:
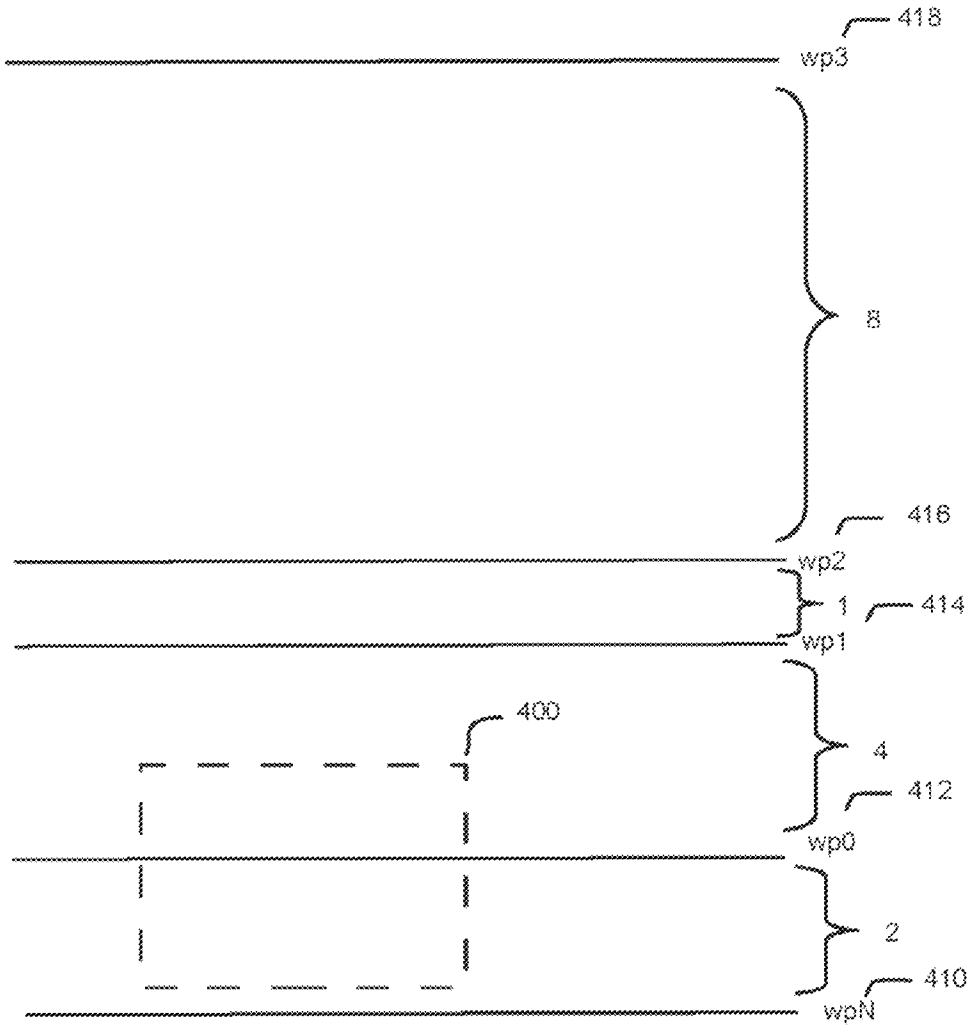
FIG. 12 shows a spatial representation of a row-write scheme where the motion of write pointers on a display is binary weighted but not in a binary sequence.

FIG. 12 presents another embodiment of a binary-weighted data sequence. In this figure, the write pointer spacing and sequence weightings corresponds to $2^1$, $2^2$, $2^0$, $2^3$. This sequence is equivalent to the sequence disclosed in FIG. 11 in terms of the number of gray scale levels support, but the difference in order may occasionally be important. The inventors have experimentally noted that placing the least significant bit $2^0$ between rows wp1 414 and wp2 416 immediately adjacent to a much higher order bit wp2 416 and wp3 418 can alleviate some difficulties in gray scale that may be related to the response time of the liquid crystal material. This configuration can be advantageous for handling LSB's. LSB's can be issue because the step response on a LCD may be much slower than the bit time. Accordingly, the LCD material has not finished rising before it is shut it off again. This rise time discrepancy may create an error in the gray level generated by the display. The previously described method may be used to add a small correction factor corresponding to an adjustment in the row spacing by one or more additional rows or such number of row or rows as desired to mitigate the error.

Figure 13A:
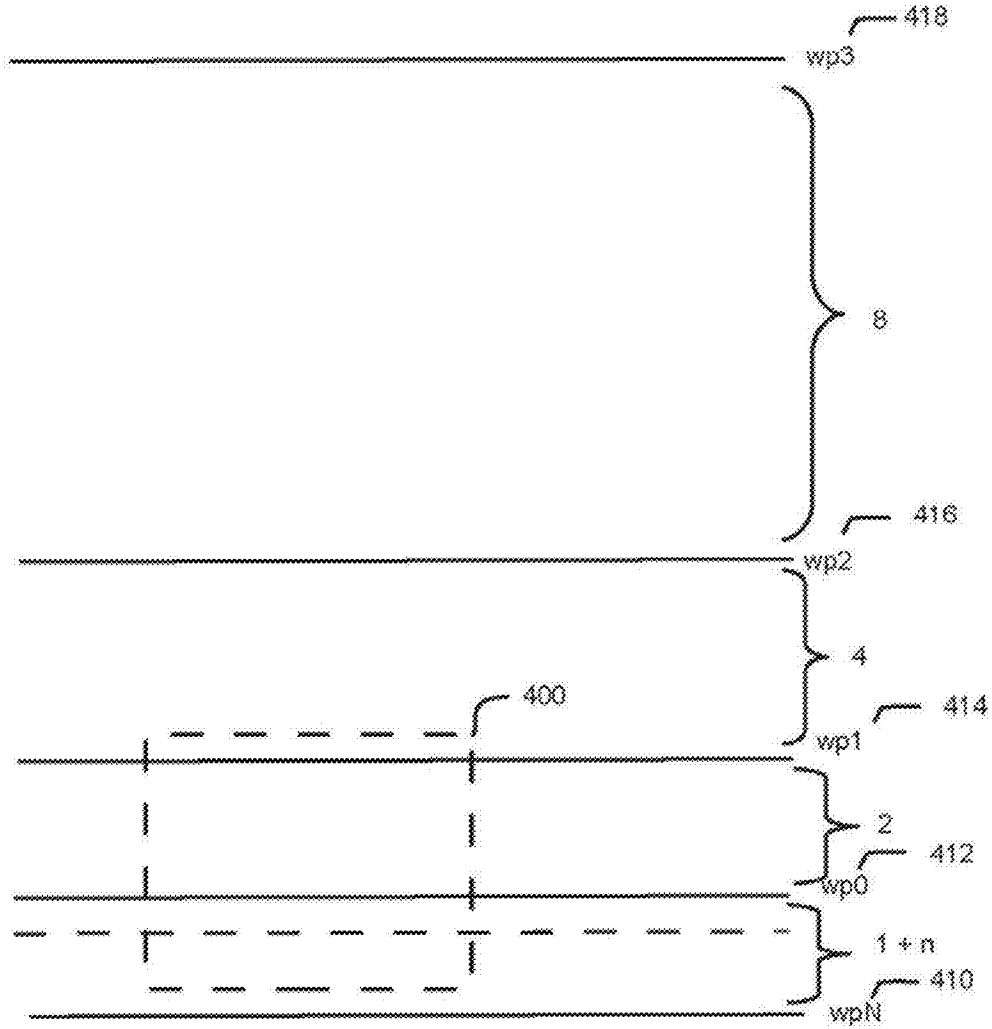
FIG. 13*a* shows a spatial representation of a row-write scheme where the motion of write pointers on a display with a stretched least significant bit in position 1.

FIG. 13*a* presents a still further embodiment of the binary weighted data sequence disclosed if FIG. 11, wherein the value of the first LSB $2^0$ is increased by the number n where n is a rational number, a fraction, whose denominator is the unmodified number of rows between wpn 410 and wp0 412 and whose numerator is a small integer number, perhaps one or two, used to increase the weighting of the LSB. This has the effect of stretching the LSB by a fraction of the binary LSB weighting. This calculation is presented in FIG. 13*b*. One purpose of the weighting is to improve the linearity of the gray scale response without being bound to a particular data sequence. In the non limiting example presented in FIG. 13*a* the data sequence is $2^0$+n, $2^1$, $2^2$, $2^3$.

Figure 14:
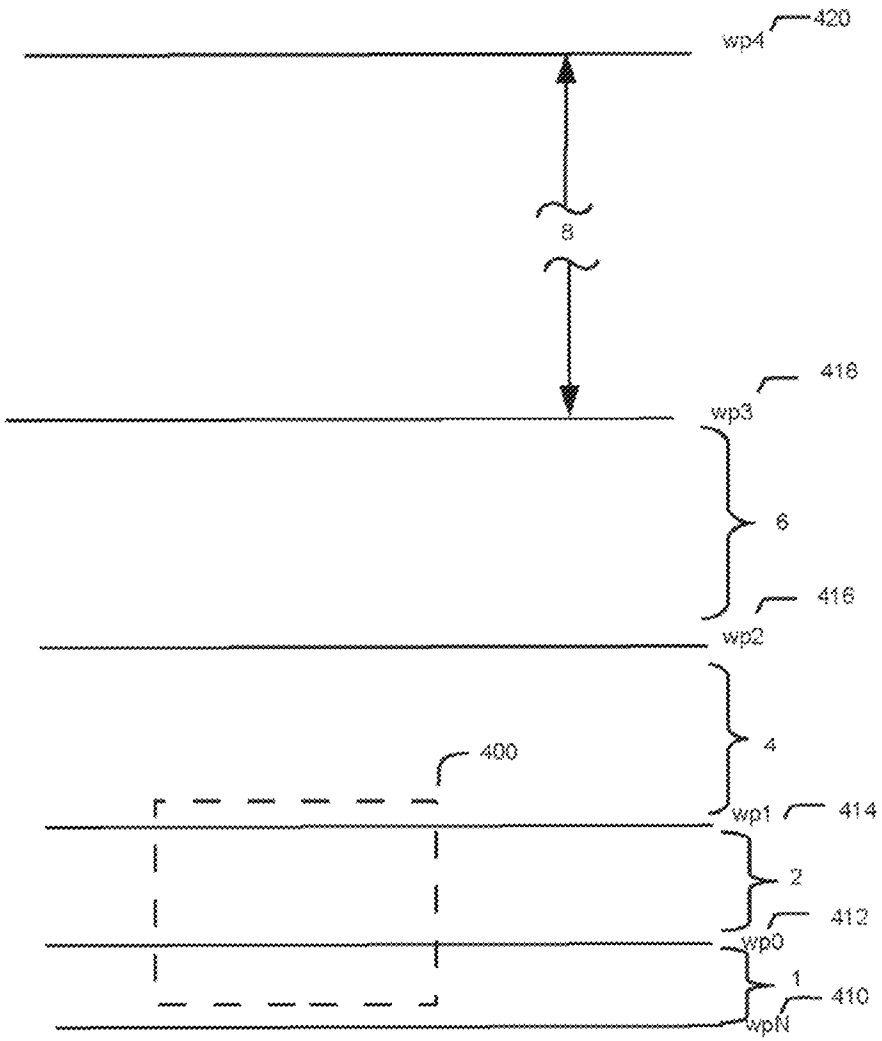
FIG. 14 shows a spatial representation of a row-write scheme with a mixed binary and non-binary weighted set of write pointers.

FIG. 14 presents another embodiment of a write pointer sequence wherein additional non-binary weightings are given to some added bit planes. In this embodiment, there is more than one sequence of bit planes that can create a given modulation gray scale weight. This approach for LCD displays is similar to that developed for use in plasma display screens to minimize dynamic false contouring effects associated with data phasing differences. See, for example, Doyen and Chevet, "New Method to increase the number of subfields in the addressing scheme of a Plasma Display Panel without losing definition or luminance," 43.3, Digest of Technical Papers, Society for Information Display, 2001. The present invention provides a version of the modulation sequences postulated therein, but implemented in a new fashion. The advantage of this embodiment of the invention is that it permits the breakup of data phasing.

In the embodiment of FIG. 14, the interval sequence for gray scale modulation is now $2^0$, $2^1$, $2^2$, $2^2$+2, $2^3$, or 1, 2, 4, 6, 8 (wp3 418 to wp4 420). The total number of levels of gray scale that can be shown is now 22—levels 0 to 21. Additionally, many intermediate gray levels can now be shown as a combination of several different bit planes. For example, the gray level eight can be generate by the bit plane weighted 8 or by the bit planes weighted 6 and 2. This adds a great level of flexibility that can be applied to the mitigation of optical artifacts.

Figure 15:
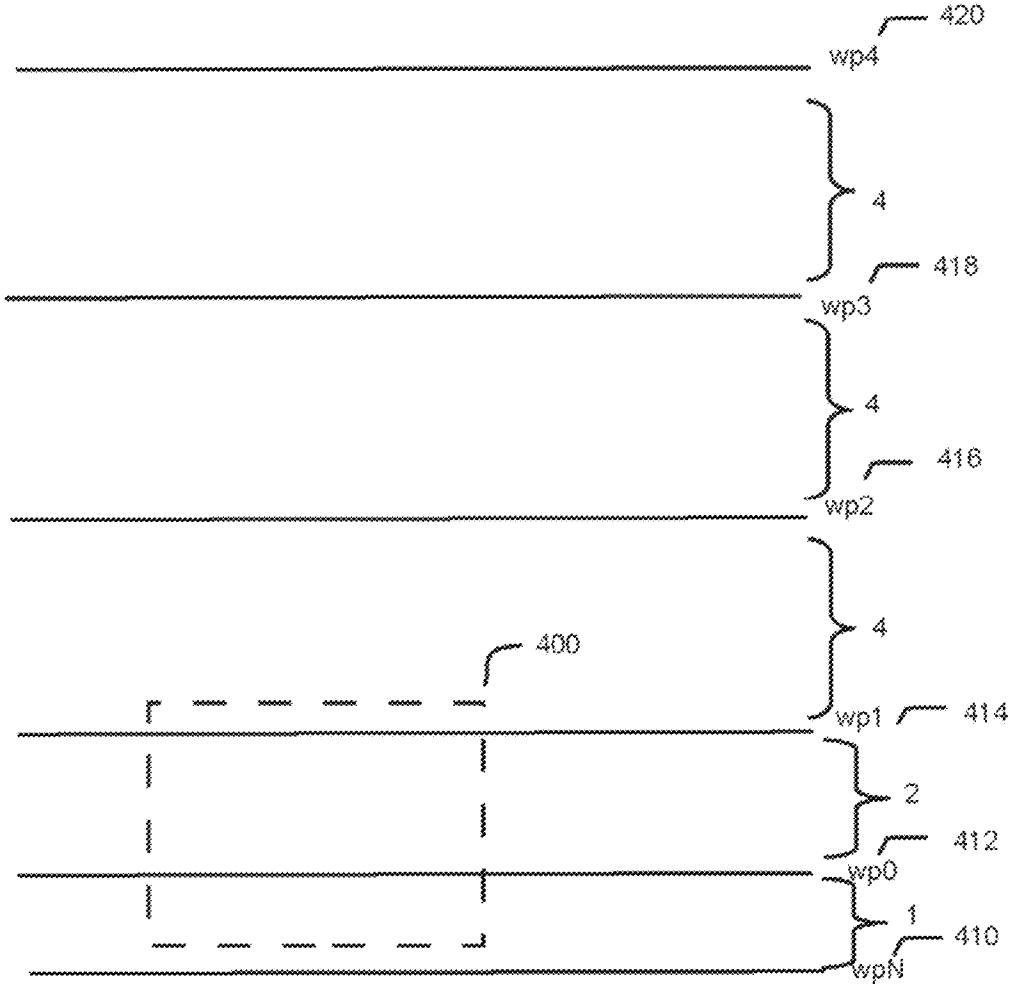
FIG. 15 shows a spatial representation of a row-write scheme with binary weighted write pointers having uniform weighted higher order bits.

FIG. 15 shows another embodiment of a write pointer scheme where lower bits are binary weighted bit planes and where higher bit plane weights are all of an equal binary value. In this embodiment, the bit plane sequence is $2^0$, $2^1$, $2^2$, $2^2$, $2^2$. All bit weights from 0 to 15 can be display with equal temporal efficiency. With appropriate preprocessing all higher order bit plans can be kept in phase to reduce such optical defects as dynamic false contouring or liquid crystal lateral field effects.

Figure 16:
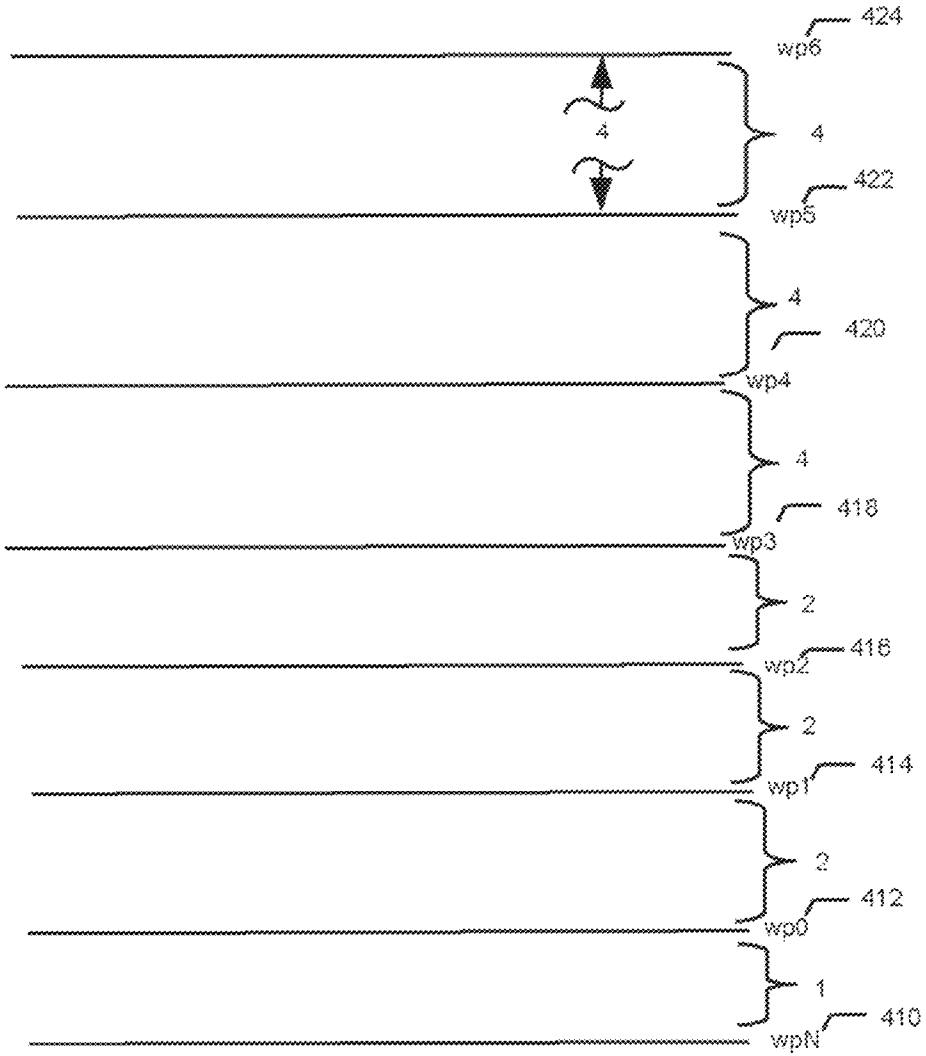
FIG. 16 shows a spatial representation of a row-write scheme with binary weighted write pointers having uniform weighted higher and lower order bits.

FIG. 16 depicts yet another embodiment of a write pointer scheme where three separate bit plane weightings are present. The least significant bit represents one bit plane weighting implemented once as $2^0$, three bit planes have the identical weighting $2^1$ and three bit planes have a second identical weighting $2^2$. The sequence shown can develop gray scale levels from 0 to 15 with the same temporal efficiency as the original binary weighted sequences mentioned in the description of FIG. 11.

Figure 17:
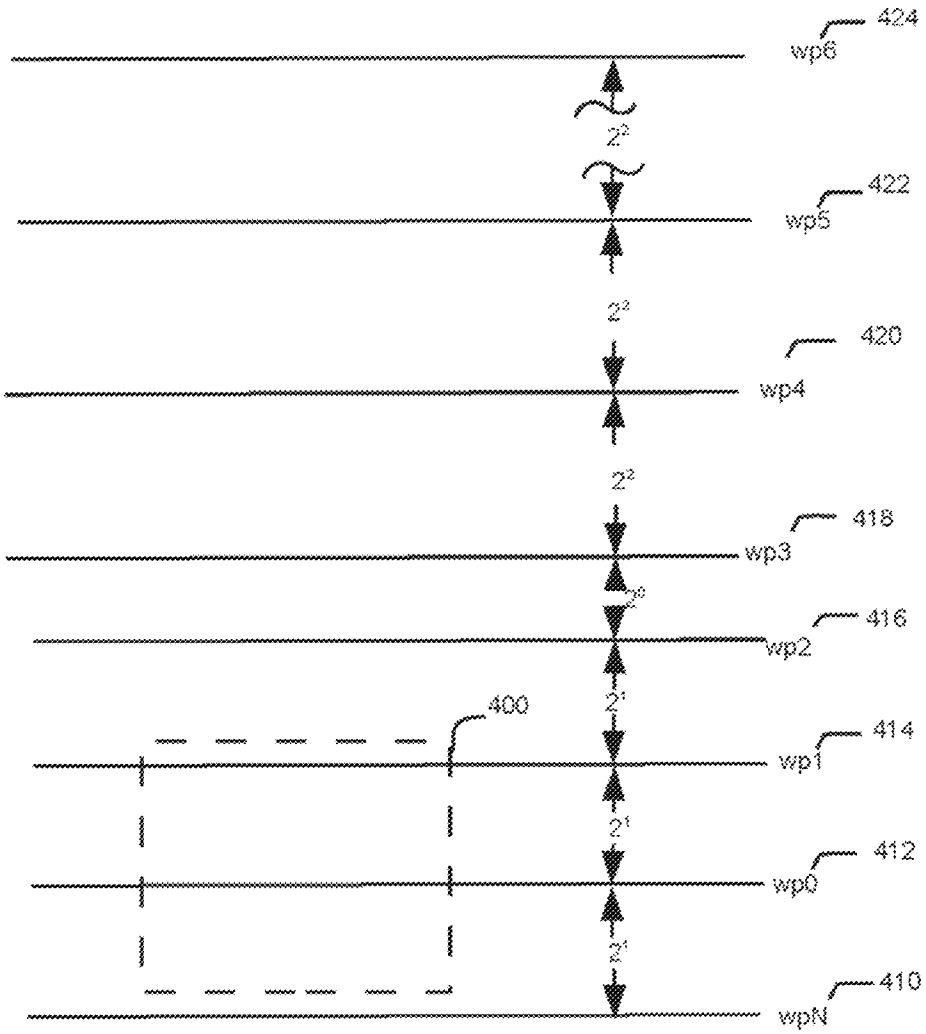
FIG. 17 shows a spatial representation of the motion of write pointers on a display with 3 bit-plane weightings.

FIG. 17 depicts another embodiment of the gray level scheme disclosed for FIG. 16 above. In this sequence the LSB bit plane weighted at $2^0$ is placed between the three bit planes for $2^1$ and the three bit planes for $2^2$. A feature of this invention is that a bit plane parser may allocate higher order bits for $2^2$ so that the slot adjacent to the LSB is populated first and the others in sequence afterward. Likewise the bit plane parser may allocated middle order bit for $2^1$ such that the slot adjacent to the LSB is populated first and the other bits are then added in sequence. This creates a drive scheme where the data phasing errors are minimized and where the LSB is bounded by bit planes likely to be populated for a high number of gray levels with the result that the likelihood of erratic drive from the LSB as described above is minimized.

Figure 18:
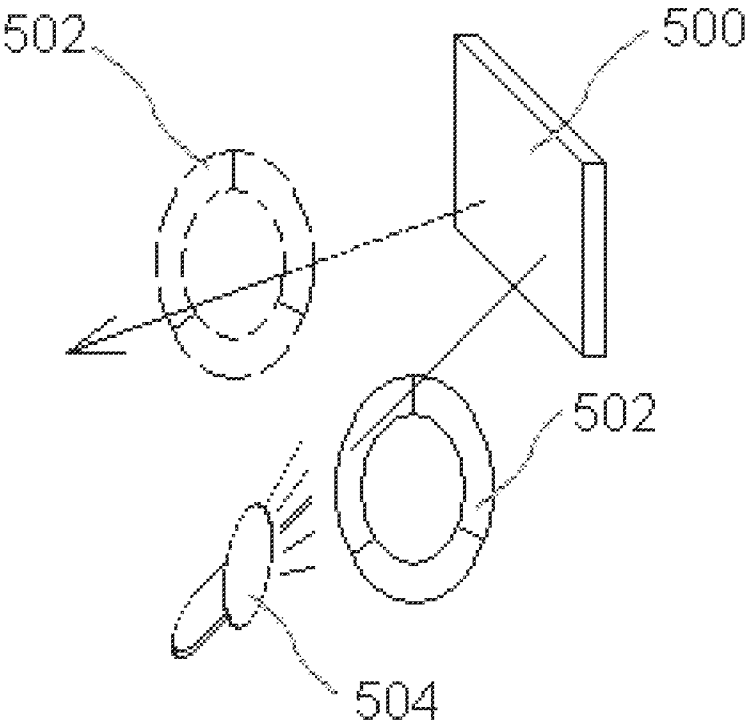
FIG. 18 shows a display according to the present invention for use with a color wheel.
Figure 19:
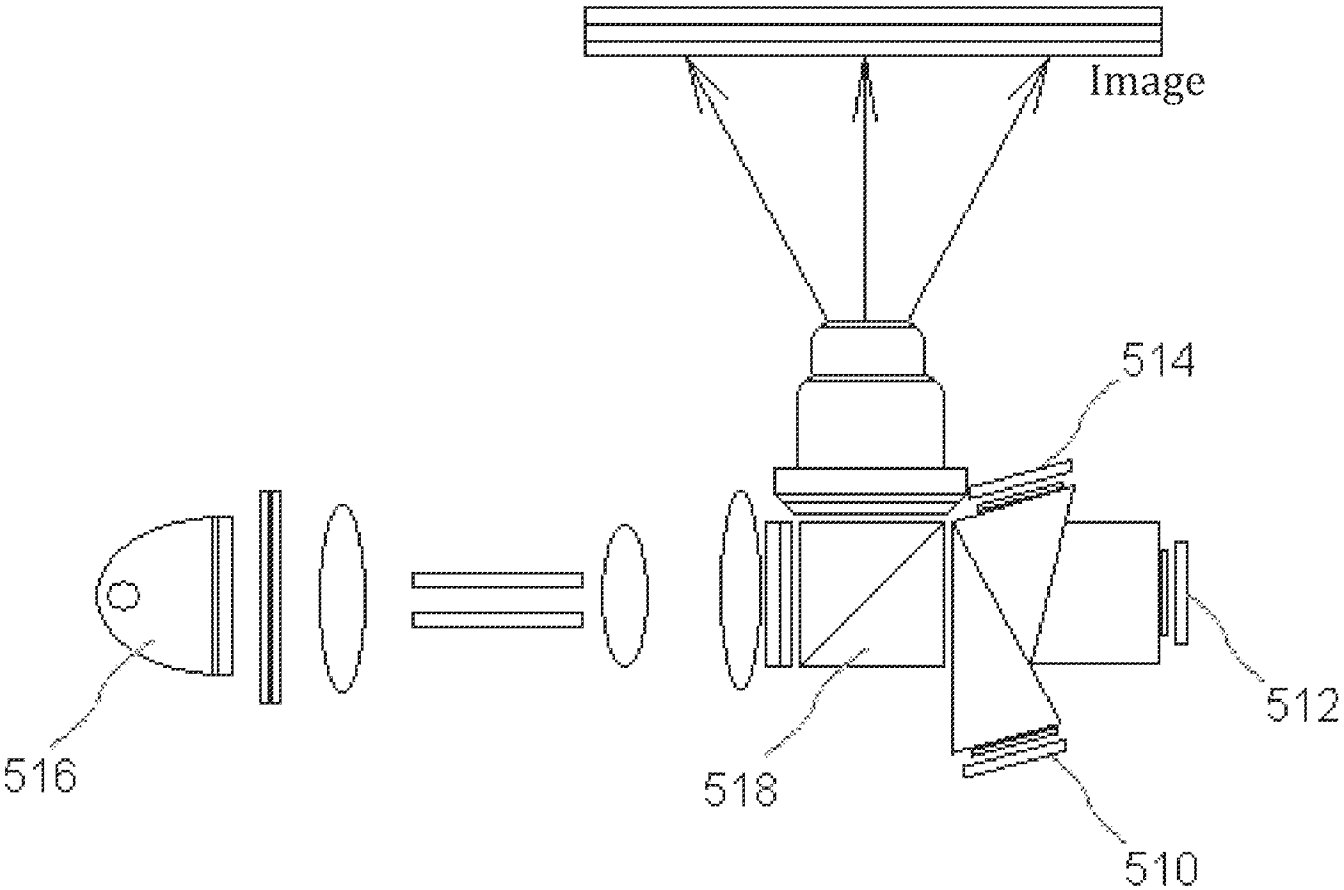
FIG. 19 shows multiple displays according to the present invention for use in projecting an image.

Referring to FIGS. 18 and 19, a display according to the present invention is configured for use in projecting an image. As seen in the embodiment of FIG. 18, a display 500 using a gray scale modulation scheme according to the present invention may be optically coupled to a color wheel 502. A light source 504 may be used to project light onto the display 500. In some embodiments, the color wheel 502 (shown in phantom) may also be located downstream from the display 500. The color wheel 502 may be synchronized with the display to project gray scale images of each color on the wheel. In still further embodiments, the color wheel 502 may be replaced by a solid state (liquid crystal) color sequencing device such as those available from ColorLink of Boulder, Colo. This is functionally similar to the color wheel although the timing and relative mixture of the color can be controlled electronically whereas a color wheel has a fixed relationship between the colors based on how it was originally constructed and on the rotation speed. Similarly LEDs may be used for near eye devices. The LEDs can be dynamically controlled or they can operate in a fixed manner similar to a color wheel.

FIG. 19 shows one embodiment where three displays 510, 512, and 514 according to the present invention may be used for projecting an image. A light source 516 and optics 518 may be used to direct light toward the displays and then to produce the image. Each display 510, 512, and 514 may be used with a color filter or devices as known in the art so that each display creates a gray scale image of one color which is then combined through the optics 518 and projected outward. The displays according to the present invention may also be used in other multi-display devices as known in the art.

Figure 20:
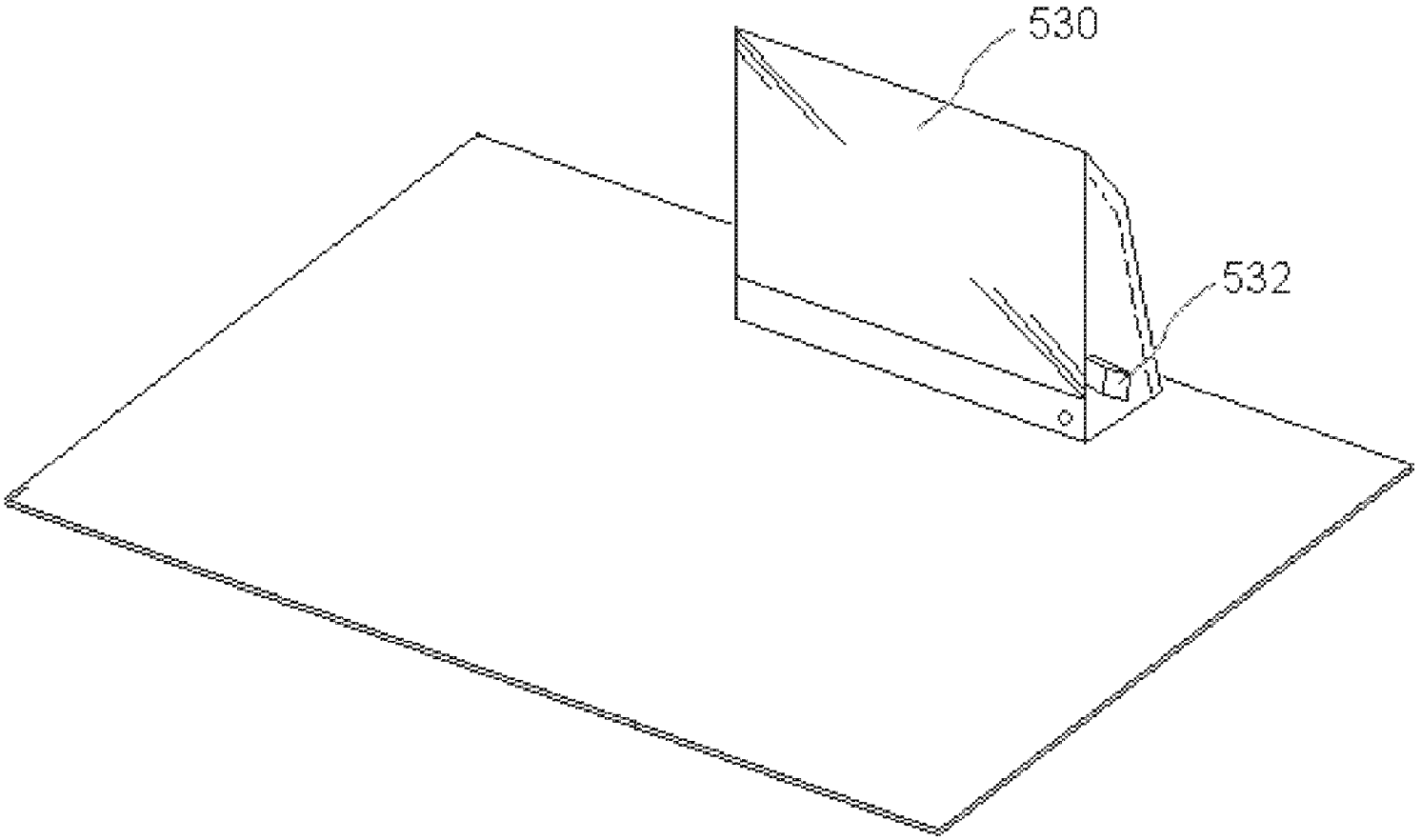
FIG. 20 is a schematic view of a television or monitor using a display according to the present invention.
Figure 21:
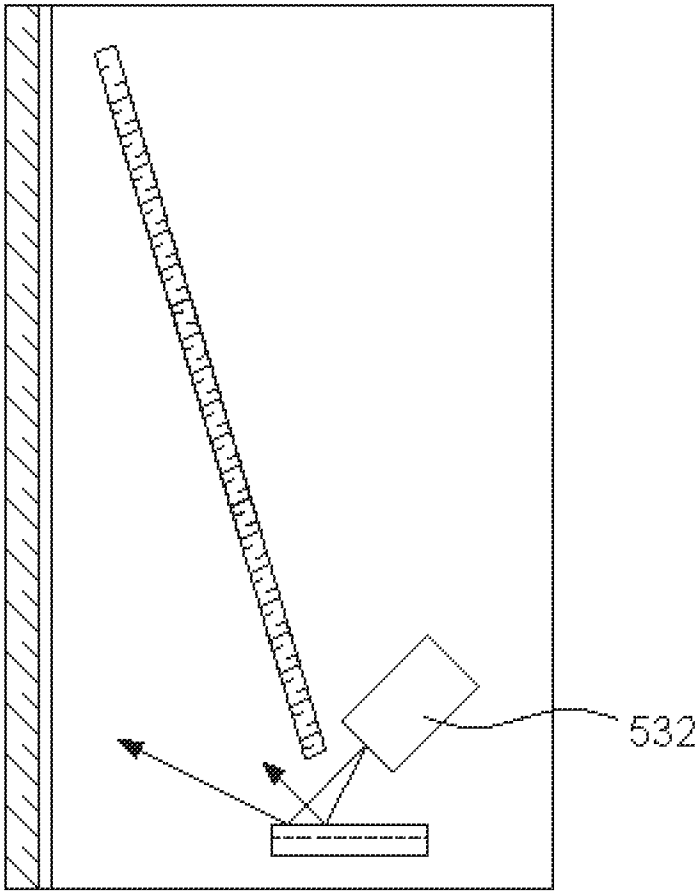
FIGS. 21 and 22 show configurations for a projection device using a display according to the present invention.
Figure 22:
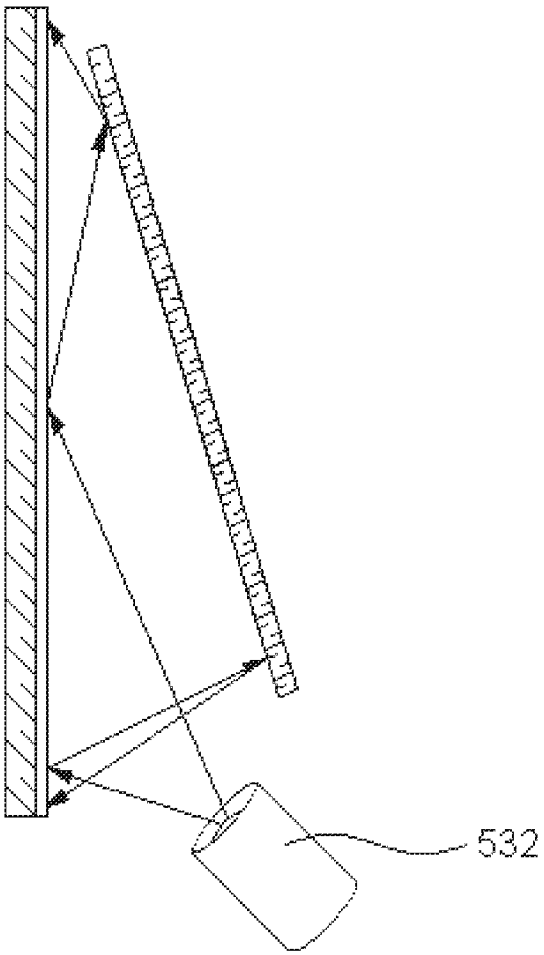

Referring now to FIGS. 20 through 22, a display according to the present invention may be used in a variety of applications. As nonlimiting example, FIG. 20 shows a schematic of a television or monitor 530 incorporating a display 532 according to the present invention. The television or monitor 530 may be a rear projection device as shown in FIG. 21 or 22. Various configurations may be used to project a larger image from display device 532. A front projection device (not shown) similar to that shown in FIG. 19, may also be used to create an larger image from a display device 532.

Figure 23:
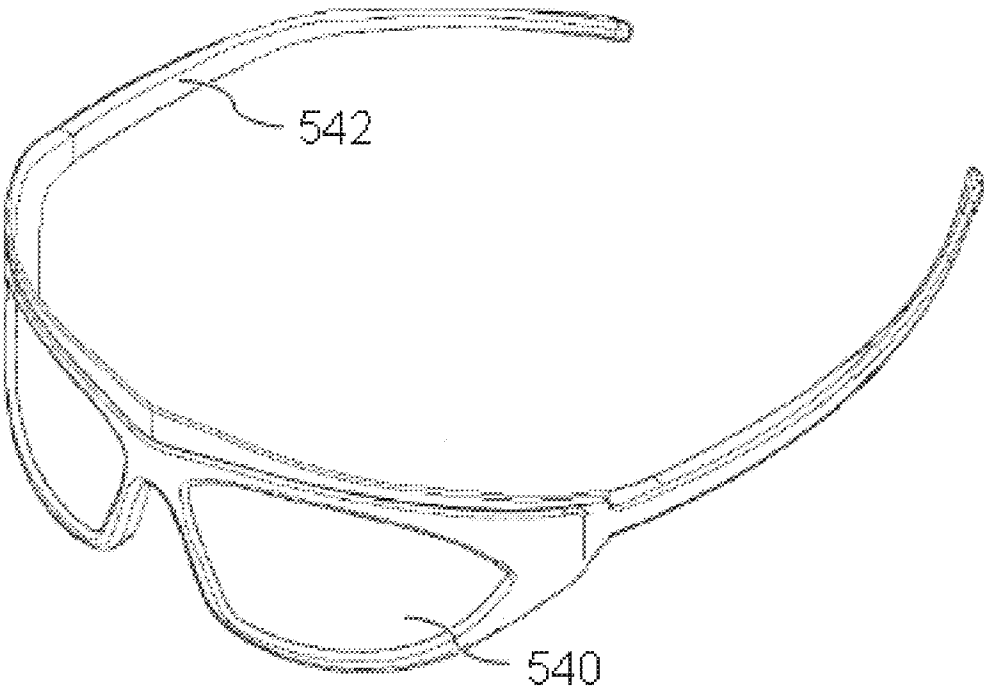
FIG. 23 shows a near-eye application of a display according to the present invention.

FIG. 23 shows that a display 540 according to the present invention may also be used in near-eye applications such as on a pair of glasses 542, googles, or other gear that may position the display 540 close to the head of the user. The display 540 may be within 3 inches of the user.

Although the invention has been described and illustrated in the above description and drawings, it is understood that this description is by example only and that numerous changes and modifications can be made by those skilled in the art without departing from the true spirit and scope of the invention. Each of the foregoing descriptions can be extended or merged with others without exceeding the scope of this invention. The use of row write spacing as a method of gray scale generation is the unique invention claimed. As a nonlimting example, a variety of different row spacings and weights may be used for gray scale generation. As another nonlimiting example, additional physical write pointers be used to service the virtual write pointers on the display. The use of more than one physical write pointer is anticipated in the descriptions below as being equivalent to the use of a single physical write pointer in all respects except for the aforementioned bandwidth. As another nonlimting example, a device using 256 write pointers, all equal to one lsb, may be used to create gray scale (although the device would be enormously inefficient of bandwidth).

In some embodiments of the present invention, virtual write pointers progress across the screen at the same rate. In one mode of operation, each virtual write pointer is serviced by a physical write pointer in turn and then that virtual write pointer address is incremented or decremented to the row above or below it. The physical write pointer services the remaining virtual write pointers in sequence and then begins the writing again. In some instances there may be an intervening interval between the writing of the last virtual write pointer in sequence and the start of the next sequence of writings. Again, this is to insure that the velocity of the write pointers is constant and is a consequence of the fact that the number of virtual write pointers that are active on the display may vary as the associated bit weightings vary.

In the drawings associated herein, a presumption is made that the virtual write pointers move down the display, such as indicated by arrow 408 in FIG. 11. It should be understood, however, that in any of the above embodiments, the virtual write pointers could move up the display, or to the left or to the right, or in some combination of the above, or in some other direction.

The servicing of virtual write pointers is assumed to be linear in the present discussions. It would be possible to service the virtual write pointers in a manner other than linear without deviating from the intention of this invention. Indeed, it may be possible to vary the write order slightly to create minor variations of less than one LSB in the gray scale values of the pixels in a given row. This would be in support of techniques such as error diffusion and the like used to reduce the visibility of gray scale contouring.

In any of the embodiments above, it may be possible to incorporate more than one physical write pointer. As a nonlimiting example, the display may be divided into segments such as a top third, middle third, and bottom third. One physical write pointer may be used for writing rows in each section. In another nonlimiting example, the physical write pointers may be interleaved instead of being separated into different section. There may also be some combination of the two embodiments mentioned above where the write pointers may be interleaved in one section, but not interleaved in another section.

Although not an efficient embodiment, if there is only one write pointer, it may be possible to write the entire display from top to bottom (or other orientation) and then come back and overwrite it again. In order to have different gray levels we would be rewriting the same data over the top of the thing and not changing some bits and changing others. This would be the least efficient arrangement. In addition, it should be noted that embodiments of the present invention may include a mix of binary and non-binary weightings or even one that is completely not binary. The present invention may be particular useful with microdisplays such as those available from eLcos of Sunnyvale, Calif.

Expected variations or differences in the results are contemplated in accordance with the objects and practices of the present invention. It is intended, therefore, that the invention be defined by the scope of the claims which follow and that such claims be interpreted as broadly as is reasonable. The invention, therefore, is not to be restricted, except by the following claims and their equivalents.

What is claimed is:

1. A method of modulating an array of pixels, wherein the array of pixels responds to changes in data on a pixel by changing a modulation of a light by said pixel responsive to said data, the method comprising:

determining a row write sequence comprising a pattern of at least two virtual write pointers operative to point said data to a same number of rows on said array of pixels according to a time ordered sequence, wherein a first virtual write point in said row write sequence is separated from a second virtual write pointer in said row write sequence by a non-zero number of rows, and wherein each of said virtual write pointers points to a row of said array of pixels that is separate from other rows of said array of pixels that are pointed to by temporally adjacent virtual write pointers by a predetermined number of rows; and applying said row write sequence comprising said pattern of at least two virtual write pointers to a set of rows, wherein said first virtual write pointer points data for a first row to said first row and said second virtual write pointer points data for a second row to said second row, continuing until all virtual write pointers in said row write sequence have pointed data for said remaining rows, if any, to said remaining rows, wherein all virtual write pointers of said row write sequence point said data to all rows comprising said set of rows within a time period equal to an interval of time beginning when data corresponding to a first modulation duration is written to a row and ending when data is next written to that same row to end that first modulation duration, and wherein all virtual write pointers progress from row to row on said display at a same velocity so that row spacings determined in said row write sequence are proportional to a modulation time required to achieve a desired modulation level on each pixel of each row.

2. The method of claim 1 wherein said row write sequence comprises a pattern of at least three virtual write pointers, wherein said first virtual write pointer points to a first row separated by a first, non-zero number of rows from a second row pointed to by said second virtual write pointer, and wherein said second row pointed to by said second virtual write pointer is separated from said third row pointed to by said third write pointer by a second non-zero number of rows, and wherein said first number of non-zero rows differs from said second number of non-zero rows.

3. A pulse width modulated array of pixels, wherein said array of pixels is divided into at least two sections, each comprising a plurality of rows wherein said array of pixels responds to changes in data on a pixel by changing a modulation of a light by said pixel responsive to said data, said array of pixels comprising:

an array of pixels operative to receive data directed to a row by a virtual write pointer, wherein the row structure of said array of pixels comprises an addressable row scheme, operative to address rows individually;

wherein said array of pixels receives data directed to rows of the array of pixels based on a pattern of virtual write pointers, wherein said pattern of virtual write pointers is operative to direct data to a first row in each section of said array of pixels according to a predetermined order of said sections; and wherein said pattern of virtual write pointers is operative to direct data to a second row in each section of said array of pixels according to said predetermined order of said sections; and wherein each said first row in a section is separated from each said second row in the same section by a number of rows comprising at least one row, and wherein said first virtual write pointer in each section is separated from said second virtual write pointer in that same section by a non-zero number of rows, and wherein each of said virtual write pointers points to a row within a section that is separate from a different row pointed to by a temporally adjacent write pointer within said same section by a pre-determined number of rows; and wherein in a second application of said data to said array of pixels, said pattern of virtual write pointers directs data to said at least two sections with at least one row offset from said earlier first row in each section, and wherein said pattern repeats said previously described row write actions within each said section with said at least one row offset, said offset being the same in all instances; and continuing until all write pointers have directed data to all rows of said array of pixels;

wherein at least one row written with said data directed to that row by a first write pointer is subsequently written with data directed to that row by a write pointer at a different position in said pattern of virtual write pointers.

4. The array of pixels of claim 3 wherein said row write sequence comprises at least three virtual write pointers in each section, where said first virtual write pointer in each section points data to a first row separated by a first, non-zero number of rows from a second row to which data is pointed by said second virtual write pointer with each said section, and wherein said second row in each section pointed to by said second virtual write pointer within each section is separate from said third row pointed to by said third write pointer by a second, non-zero number of rows, and wherein said first number of non-zero rows differs from said second number of non-zero rows.

5. The array of pixels of claim 3 wherein said row write sequence comprises at least three virtual write pointers, where said first virtual write pointer points data to a first row separated by a first, non-zero number of rows from a second row to which data is pointed by said second virtual write pointer, and wherein said second row pointed to by said second virtual write pointer is separate from said third row pointed to by said third write pointer by a second, non-zero number of rows, and wherein said first number of non-zero rows differs from said second number of non-zero rows.

6. A pulse width modulated array of pixels comprising a plurality of rows wherein said array of pixels responds to changes in data on a pixel by changing a modulation of a light by said pixel responsive to said data, said array of pixels comprising:

an array of pixels operative to receive data directed to a row by a virtual write pointer, wherein the row structure of said array of pixels comprises an addressable row scheme, operative to address rows individually;

wherein said array of pixels receives data directed to rows of the array of pixels based on a pattern of virtual write pointers, wherein said pattern of virtual write pointers is operative to direct data to a first row of said array of pixels according to a predetermined order of said sections; and wherein said pattern of virtual write pointers is operative to direct data to a second row of said array of pixels according to said predetermined order of said sections; and wherein each said first row in a section is separated from each said second row in the same section by a number of rows comprising at least one row, and wherein said first virtual write pointer is separated from said second virtual write pointer by a non-zero number of rows, and wherein each of said virtual write pointers points to a row that is separate from a different row pointed to by a temporally adjacent write pointer by a pre-determined number of rows; and wherein in a second application of said data to said array of pixels, said pattern of virtual write pointers directs data to with at least one row offset from said earlier first row in each section, and wherein said pattern repeats said previously described row write actions with said at least one row offset, said offset being the same in all instances; and continuing until all write pointers have directed data to all rows of said array of pixels, and wherein at least one row written with said data pointed to that row by a first write pointer is subsequently written with data pointed to that row by a write pointer at a different position in said pattern of virtual write pointers.

* * * * *